US009587408B1

(12) United States Patent
Brannon

(10) Patent No.: US 9,587,408 B1
(45) Date of Patent: Mar. 7, 2017

(54) ROOF WORKMAN'S UTILITY BOX

(71) Applicant: Troy Ray Brannon, Corinth, TX (US)

(72) Inventor: Troy Ray Brannon, Corinth, TX (US)

( * ) Notice: Subject to any disclaimer, the term of this patent is extended or adjusted under 35 U.S.C. 154(b) by 0 days.

(21) Appl. No.: 14/210,327

(22) Filed: Mar. 13, 2014

Related U.S. Application Data

(60) Provisional application No. 61/779,981, filed on Mar. 13, 2013.

(51) Int. Cl.
*E04G 3/22* (2006.01)
*E04G 5/04* (2006.01)
*B25H 3/02* (2006.01)

(52) U.S. Cl.
CPC ..... *E04G 3/22* (2013.01); *B25H 3/02* (2013.01); *E04G 5/041* (2013.01)

(58) Field of Classification Search
CPC ... E06C 1/00; E06C 1/345; E06C 7/00; E06C 7/42; E06C 7/44; E06C 7/46; E06C 7/188; B25H 1/00; B25H 3/00; B25H 3/003; B25H 3/02; B25H 5/00; E04G 3/22; E04G 5/04
See application file for complete search history.

(56) References Cited

U.S. PATENT DOCUMENTS 1,026,097 A * 5/1912 Lewis ..... E04G 3/26 182/176
1,028,362 A * 6/1912 King ..... E06C 7/426 182/45
3,516,523 A * 6/1970 Pemberton, Jr ..... D06F 81/00 108/81
3,618,703 A * 11/1971 Wilke ..... E06C 7/423 182/107
4,275,797 A * 6/1981 Johnson ..... E04G 1/24 180/13
4,392,662 A * 7/1983 Hoglinger ..... B65D 90/18 280/43.23
4,412,599 A * 11/1983 McCrudden ..... E06C 1/345 182/201
4,513,939 A * 4/1985 Berger ..... F24F 13/32 248/544
4,917,345 A * 4/1990 Czech ..... F24F 13/32 248/237
(Continued)

*Primary Examiner* — Katherine Mitchell
*Assistant Examiner* — Shiref Mekhaeil
(74) *Attorney, Agent, or Firm* — Guy V. Manning

(57) ABSTRACT

A roofer's utility box includes non-rectangular sides angled downward from one end of the box to the other, defining a substantially trapezoidal box. Retractable leveling legs disposed on its downhill face extend below the box bottom to enable leveling its top surface. Roof anchors and a ridge tether on the uphill end, and a safety brace on the downhill end, secure the box in place. Lifting and towing handles cooperate with retractable castors to facilitate positioning the box. Masts extending upward from the box's downhill end, and a yard arm spanning between them, support a walkway plank to create temporary scaffolding supported by the box. A variety of exterior utility devices attach to the box and scaffolding masts, including trays, cutting and clamping surfaces and electrical and pneumatic outlets for use with power tools. The box interior may be fitted with an ice chest and/or sliding trays for convenient storage.

13 Claims, 30 Drawing Sheets

(56) References Cited

U.S. PATENT DOCUMENTS 5,249,397 A * 10/1993 Monaco ..... E04G 3/26 182/45
5,318,148 A * 6/1994 Franco ..... E04G 3/26 182/45
D368,647 S * 4/1996 Koebbe ..... D25/66
5,547,080 A * 8/1996 Klimas ..... B25H 3/02 182/129
5,570,864 A * 11/1996 Flores ..... E04G 3/26 248/148
5,609,322 A * 3/1997 Bond ..... B25H 1/12 144/285
5,624,006 A * 4/1997 Richardson, Jr. ..... E04G 3/26 182/206
5,687,514 A * 11/1997 Gillispie ..... E04D 13/0315 52/200
5,771,992 A * 6/1998 Snyder ..... E06C 7/426 182/200
5,791,092 A * 8/1998 Strieter ..... E04D 13/031 248/237
5,913,782 A * 6/1999 Monaco ..... E04G 3/26 182/45
5,927,109 A * 7/1999 Sieck ..... E05B 73/00 182/230
5,950,760 A * 9/1999 Morrison ..... B63B 57/00 182/148
5,971,102 A * 10/1999 Brown ..... E06C 7/003 182/129
6,047,750 A * 4/2000 Jensen ..... B25H 1/04 108/26
6,105,843 A * 8/2000 Dollesin ..... B60R 9/065 224/495
6,209,739 B1 * 4/2001 Samsel ..... B65D 43/167 16/412
6,343,439 B1 * 2/2002 Rutledge ..... E04D 13/1471 248/148
6,543,733 B1 * 4/2003 Pennington ..... A47B 3/0912 108/147.21
6,712,182 B1 * 3/2004 Baker ..... E04G 1/28 182/129
6,732,835 B1 * 5/2004 Souto ..... E04G 3/26 182/45
6,761,246 B2 * 7/2004 Bowles ..... E04G 1/30 182/117
6,926,241 B2 * 8/2005 Garrett ..... B23D 45/003 182/107
6,935,644 B1 * 8/2005 Oranday ..... A47J 47/18 280/47.34
7,249,771 B1 * 7/2007 Brennan ..... A47J 37/0704 280/35
7,341,164 B2 * 3/2008 Barquist ..... F16M 11/32 220/592.03
7,354,025 B2 * 4/2008 Searle ..... E04G 3/26 182/45
7,950,620 B2 * 5/2011 Knight ..... F24F 1/60 248/143
8,424,883 B1 * 4/2013 Ramos ..... B62B 3/02 108/145
8,657,144 B2 * 2/2014 Kells ..... B44D 3/14 220/570
2001/0007343 A1 * 7/2001 McElhaney, Jr. ..... B25H 5/00 248/215
2002/0027091 A1 * 3/2002 Brown ..... B25H 3/06 206/372
2002/0104709 A1 * 8/2002 Hines ..... B25H 3/006 182/129
2002/0148684 A1 * 10/2002 Charlebois, Jr. ..... E06C 7/14 182/129
2005/0161962 A1 * 7/2005 Topper ..... B66C 1/10 294/215
2006/0226310 A1 * 10/2006 Hall ..... E04D 15/02 248/148
2009/0102272 A1 * 4/2009 Hand ..... B25H 3/02 298/3
2009/0315439 A1 * 12/2009 Turner ..... F25D 25/022 312/404
2010/0127002 A1 * 5/2010 Bel ..... E04D 15/00 220/629
2011/0192874 A1 * 8/2011 McCurry ..... B60R 9/0485 224/539
2013/0043358 A1 * 2/2013 Padilla ..... E06C 7/14 248/210
2015/0027067 A1 * 1/2015 Finney ..... E04B 1/34363 52/79.5
2015/0158172 A1 * 6/2015 Conway ..... A45C 13/02 206/372

* cited by examiner

ROOF WORKMAN'S UTILITY BOX

This application claims priority from Provisional Application Ser. No. 61/779,981, filed Mar. 13, 2013.

BACKGROUND OF THE INVENTION

1. Field of the Invention

This invention relates generally to roof construction, and particularly to tools used by roof construction personnel in building and repairing roofs. More particularly, this invention relates to an adjustable utility box for holding workers' tools, scaffolding and the like, especially on sloping roofs.

2. Description of Related Art

Roofing work, including installing and repairing shingles, as well as related painting and siding work on roof dormers, involves workers walking up and down on a sloping roof where no flat surface exists. Yet, a flat surface is desirable for cutting materials, resting tools and other objects, and for standing and walking. Roofers are adept at walking on such slopes, and where the roof pitch is severe, attaching toe boards to prevent them and their tools from sliding off. A need exists for creating a temporary, flat surface on a roof.

When a flat surface is mandatory, roof workers must retreat to the ground, use the flat surface for cutting or forming whatever they need, and then return to the roof carrying the object(s). Alternately, a co-worker on the ground performs these functions on the ground while the roofing worker waits or does something else, potentially increasing labor costs. A need exists for means for saving trips up and down access ladders and for minimizing labor costs in roofing work.

Similarly, roofing workers must carry their tools with them while moving around on a pitched roof, or leave them on the ground to be retrieved or handed up when needed. A need exists for a station for keeping commonly used roofing work tools on the roof.

SUMMARY OF THE INVENTION

A roofer's utility box includes non-rectangular sides angled downward from one end of the box to the other, defining a substantially trapezoidal box. Retractable leveling legs disposed on its downhill face extend below the box bottom to enable leveling its top surface. Roof anchors and a ridge tether on the uphill end, and a safety brace on the downhill end, secure the box in place. Lifting and towing handles cooperate with retractable castors to facilitate positioning the box. Masts extending upward from the box's downhill end, and a yard arm spanning between them, support a walkway plank to create temporary scaffolding supported by the box. A variety of exterior utility devices attach to the box and scaffolding masts, including trays, cutting and clamping surfaces and electrical and pneumatic outlets for use with power tools. The box interior may be fitted with an ice chest and/or sliding trays for convenient storage.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
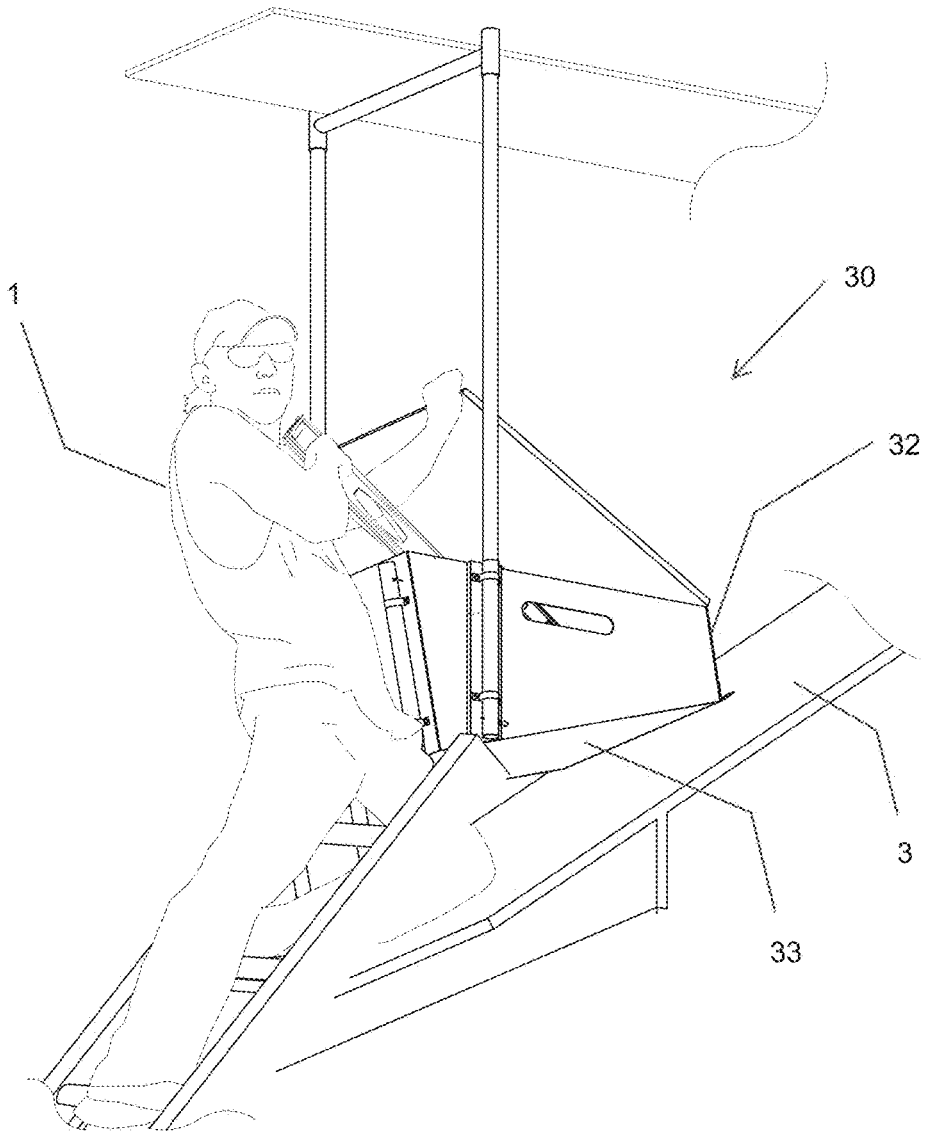
FIG. 1 depicts in quartering perspective the utility box of the present invention in use on a roof.
Figure 2:
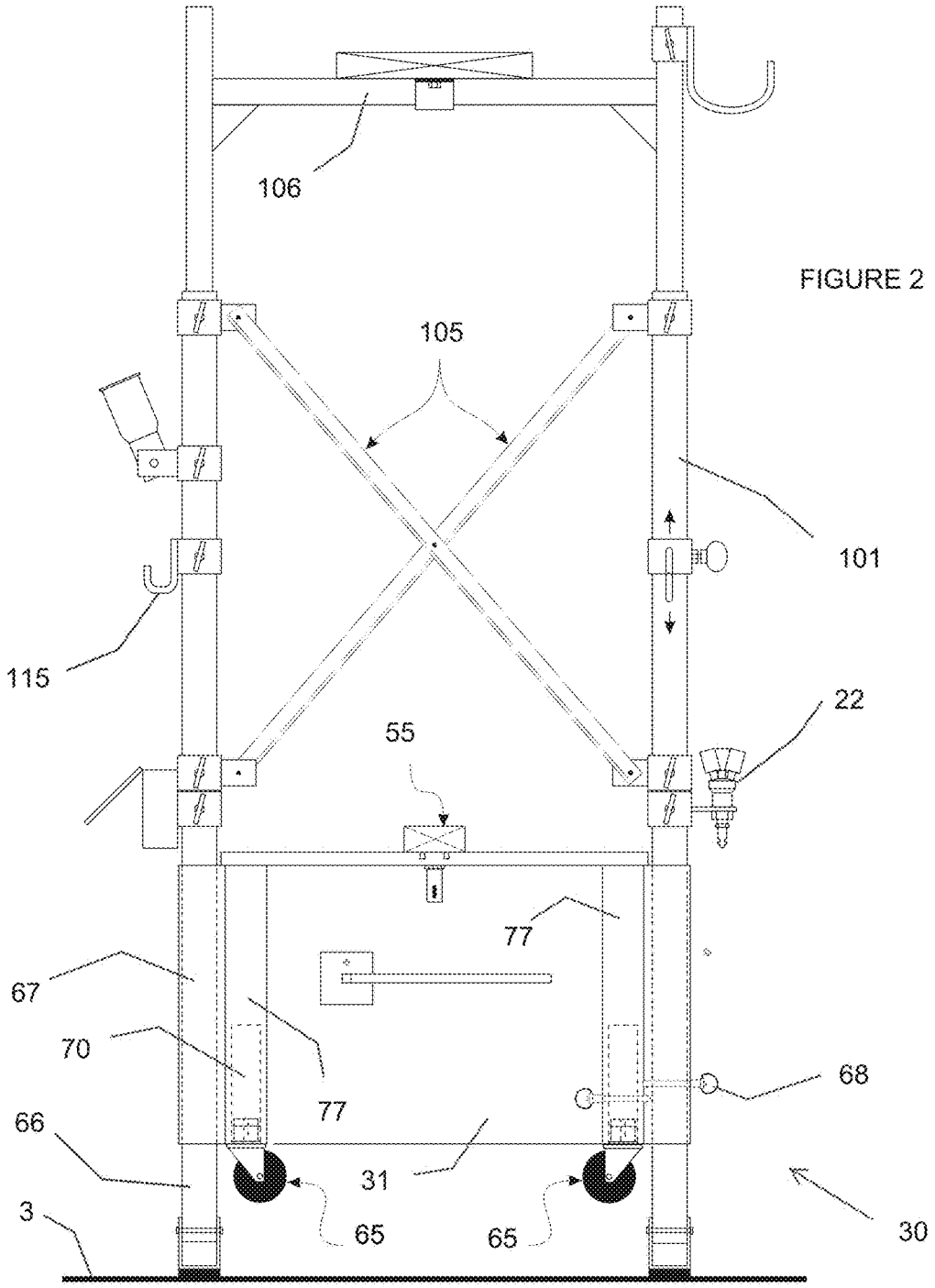
FIGS. 2-5 show in front, right and left side elevational and plan views, respectively, exterior details of the utility box of FIG. 1.
Figure 3:
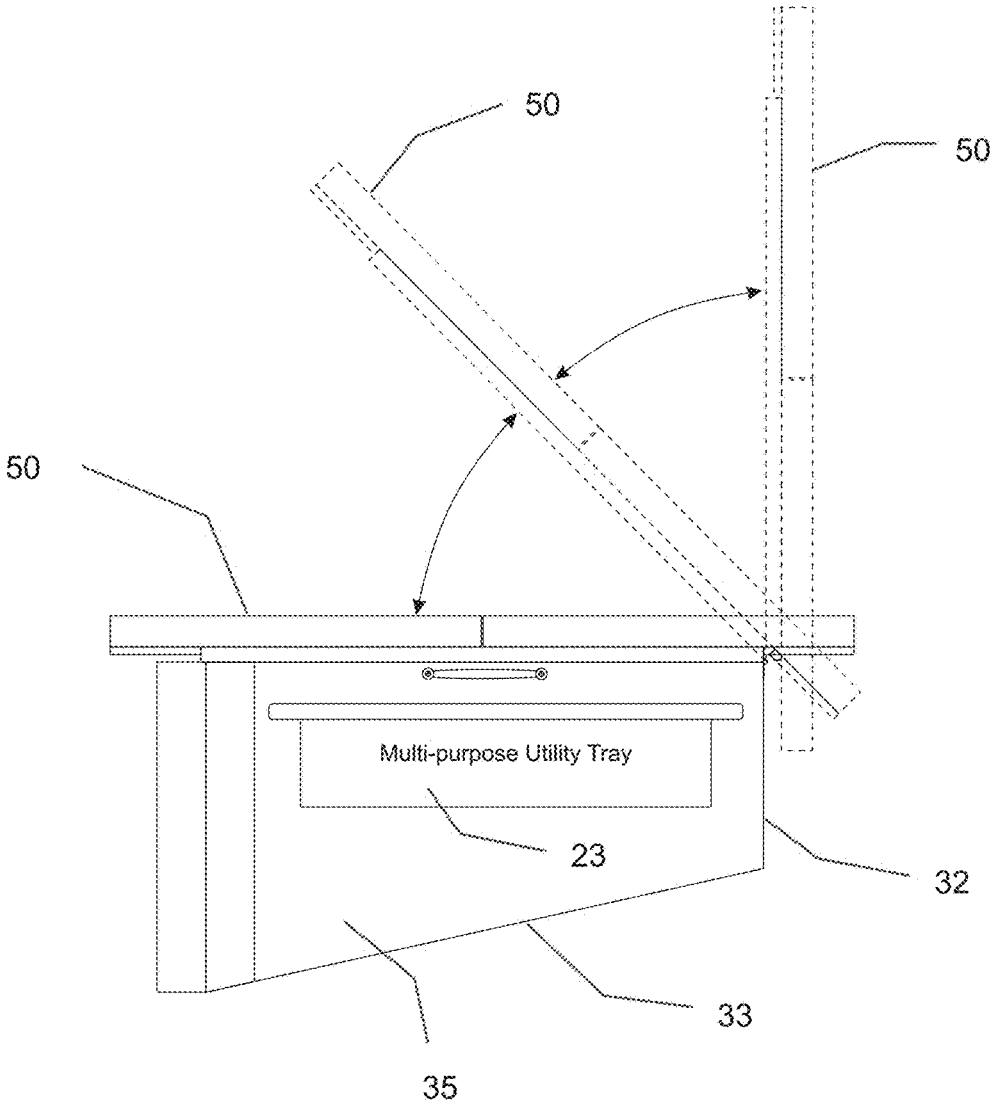
Figure 4:
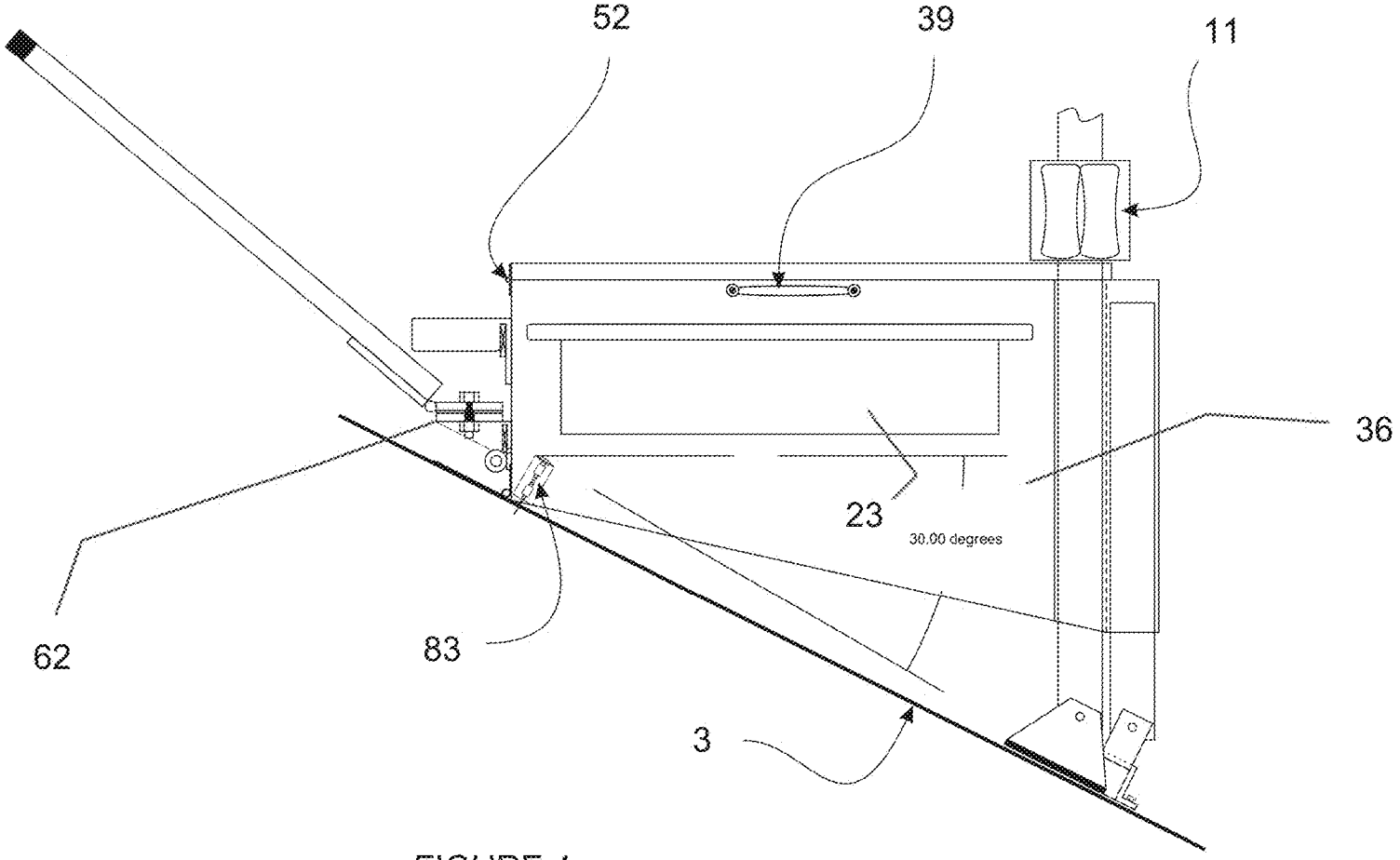
Figure 5:
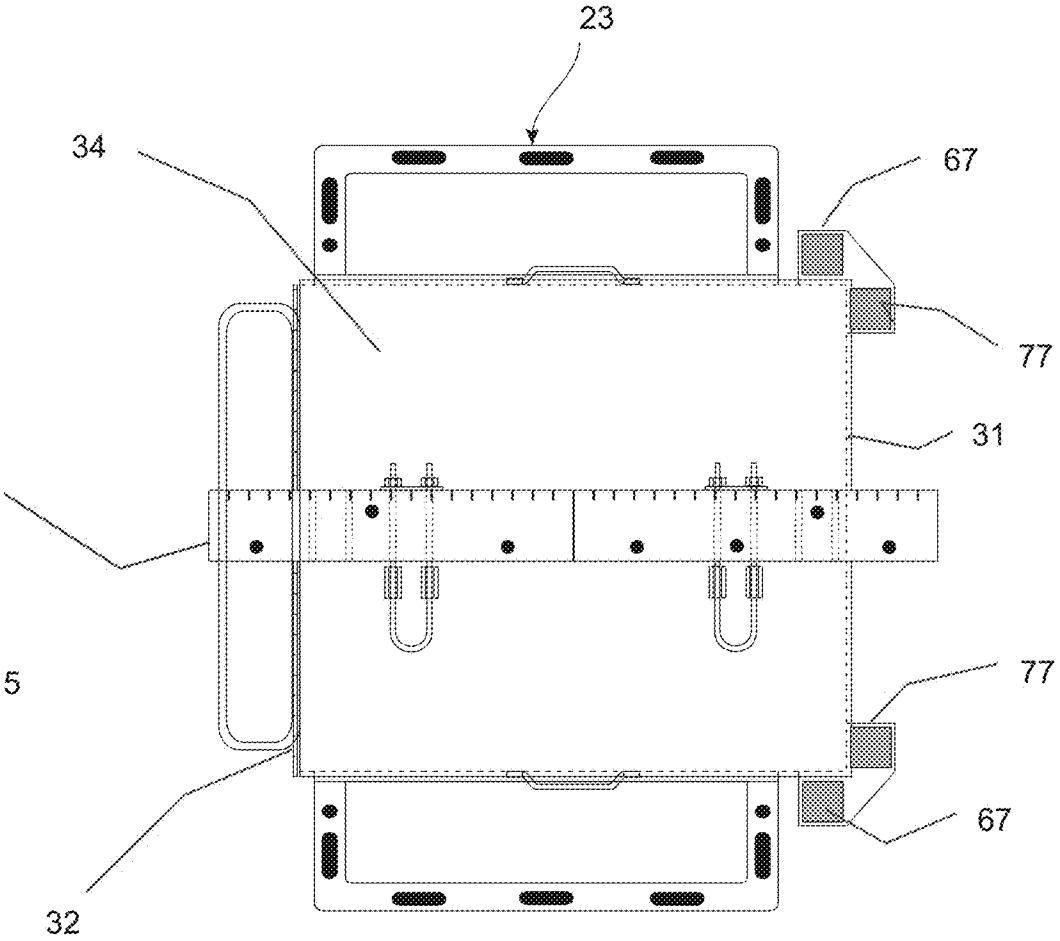
Figure 6A:
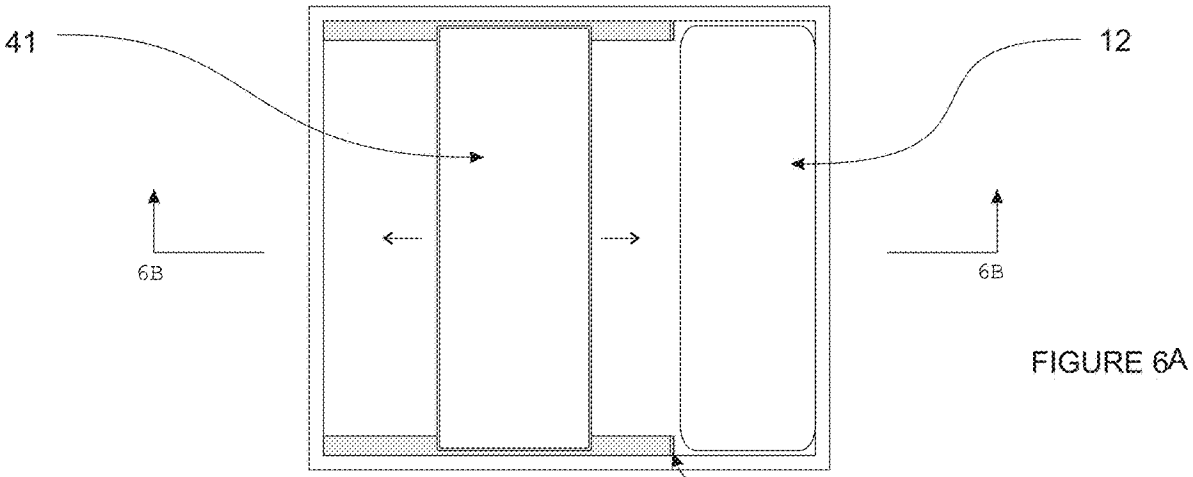
FIGS. 6A-6B detail interior components of the box of FIG. 1.
Figure 6B:
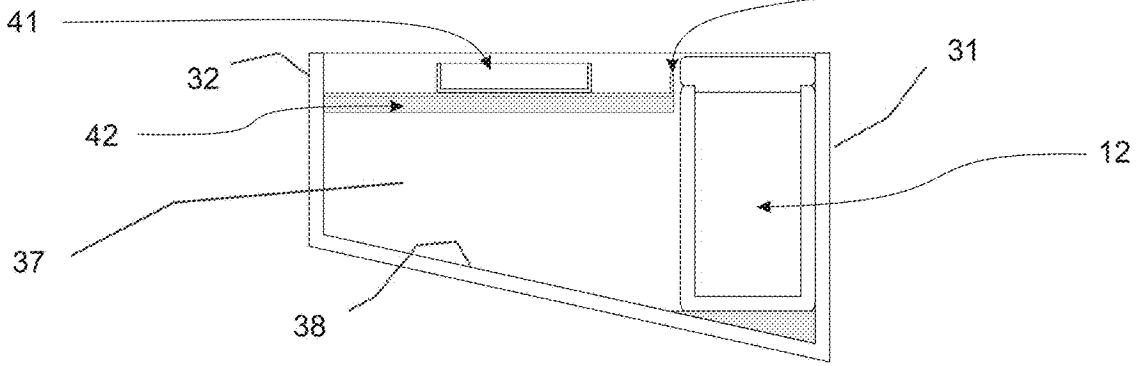
Figure 7A:
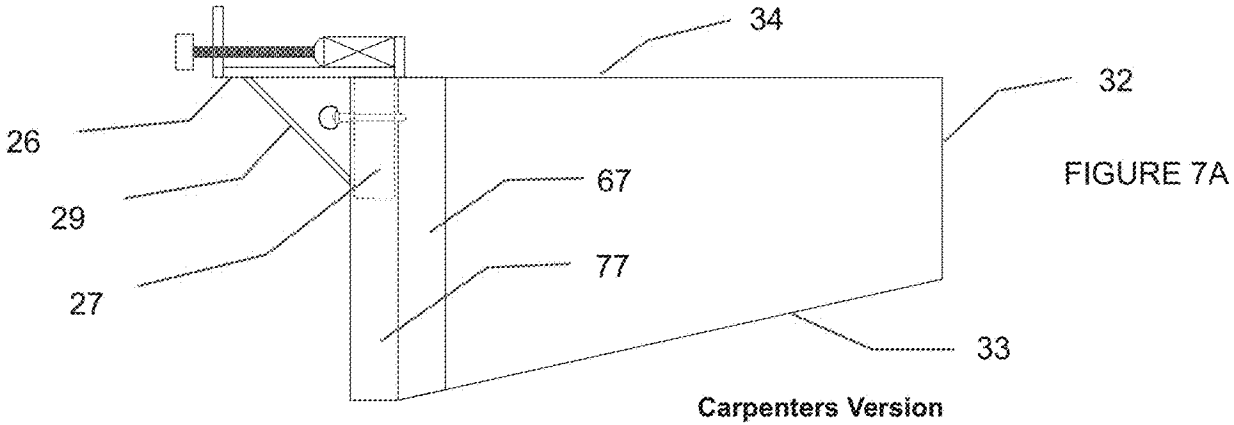
FIGS. 7A-7B show a carpenter's platform coupled to the front, downhill end of the utility box of FIG. 1.
Figure 8A:
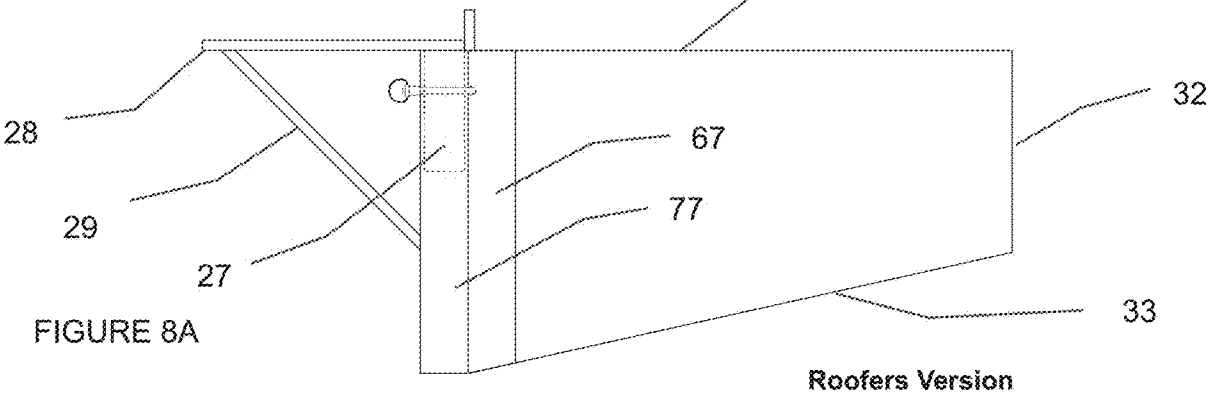
FIGS. 8A-8B depict a roofer's platform coupled to the front, downhill end of the utility box of FIG. 1.
Figure 7B:
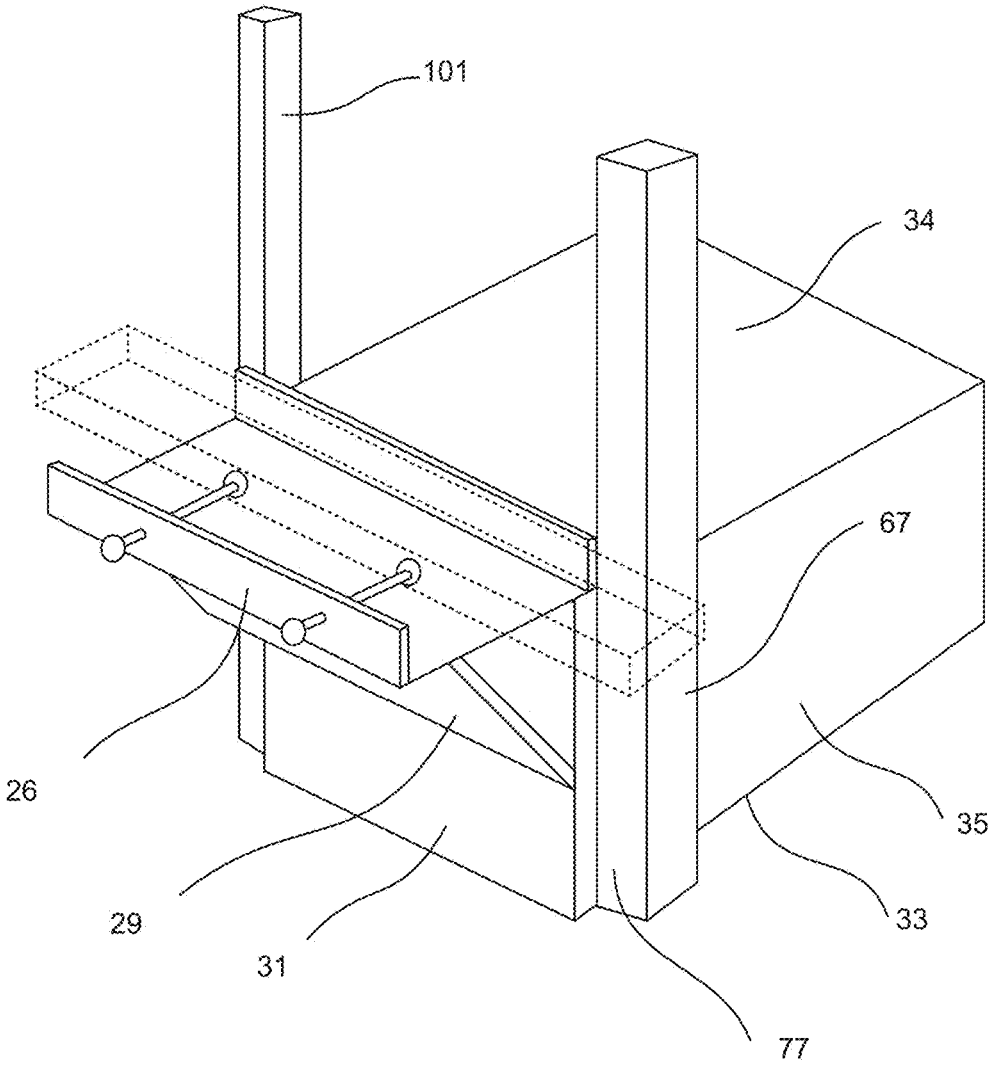
Figure 8B:
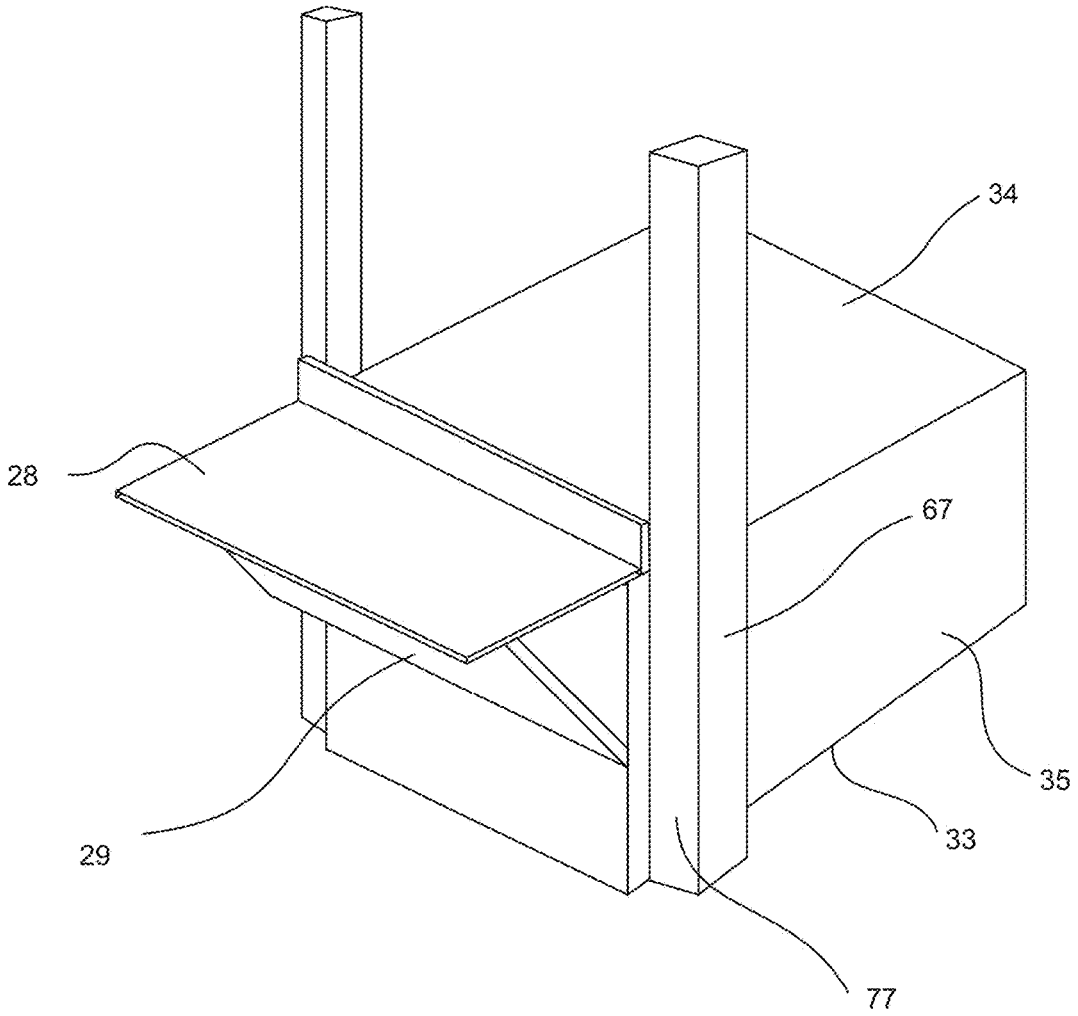
Figure 9B:
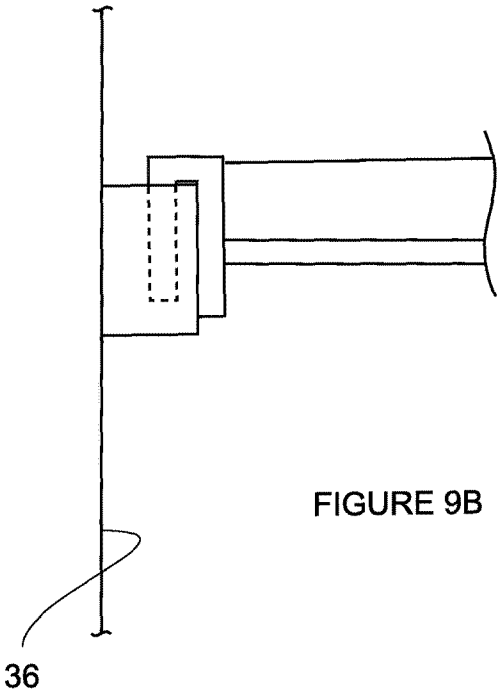
FIGS. 9A-10B detail utility trays attachable to the sides of the box of FIG. 1.
Figure 9A:
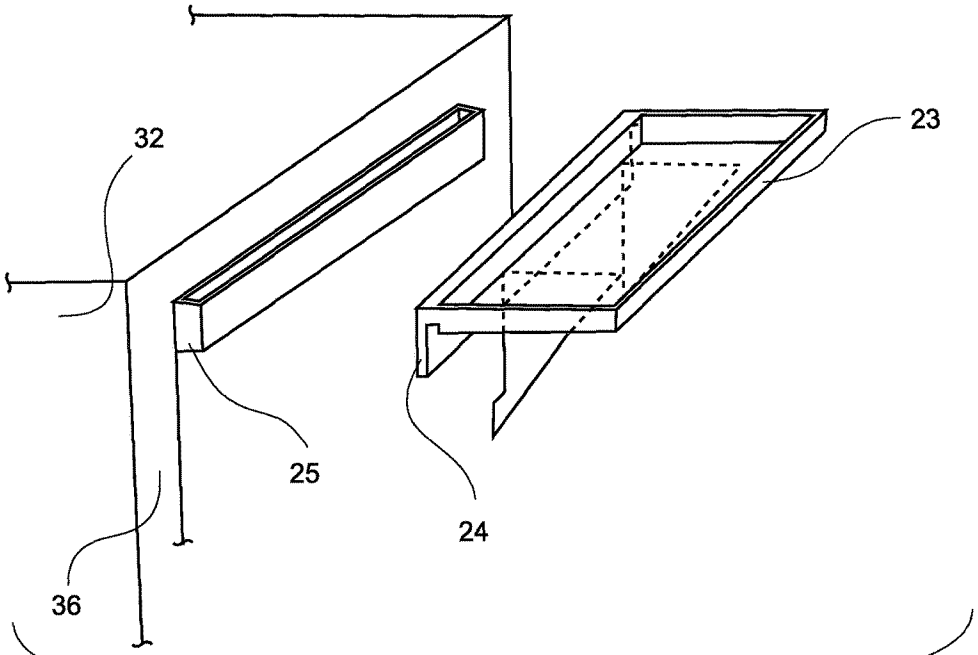
Figure 10B:
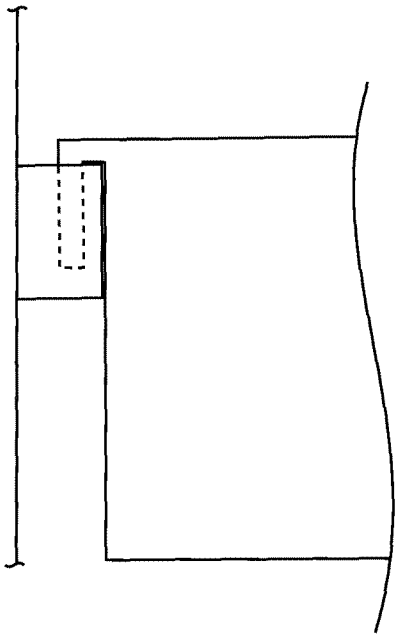
Figure 10A:
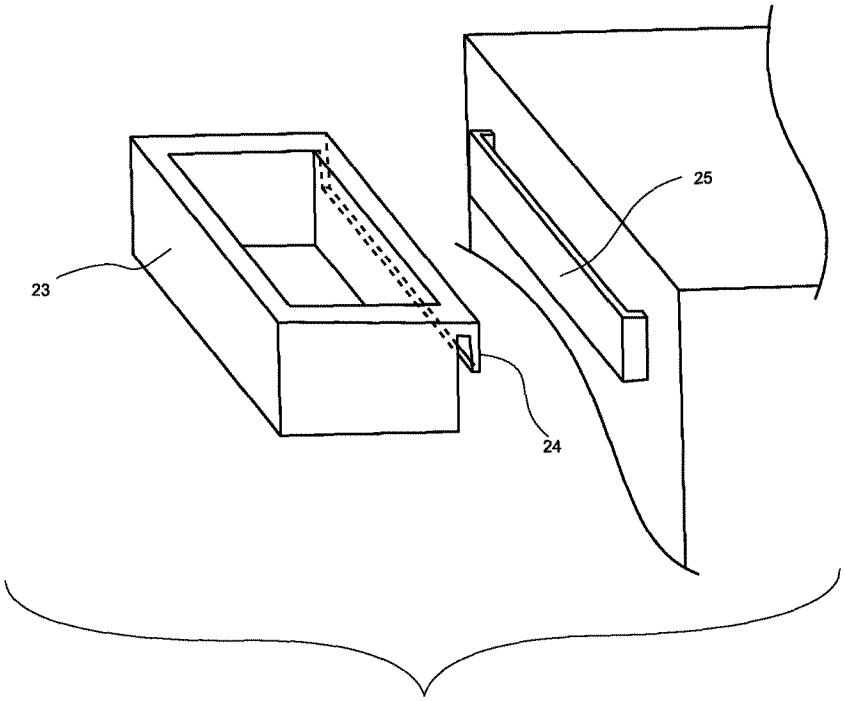
Figure 11:
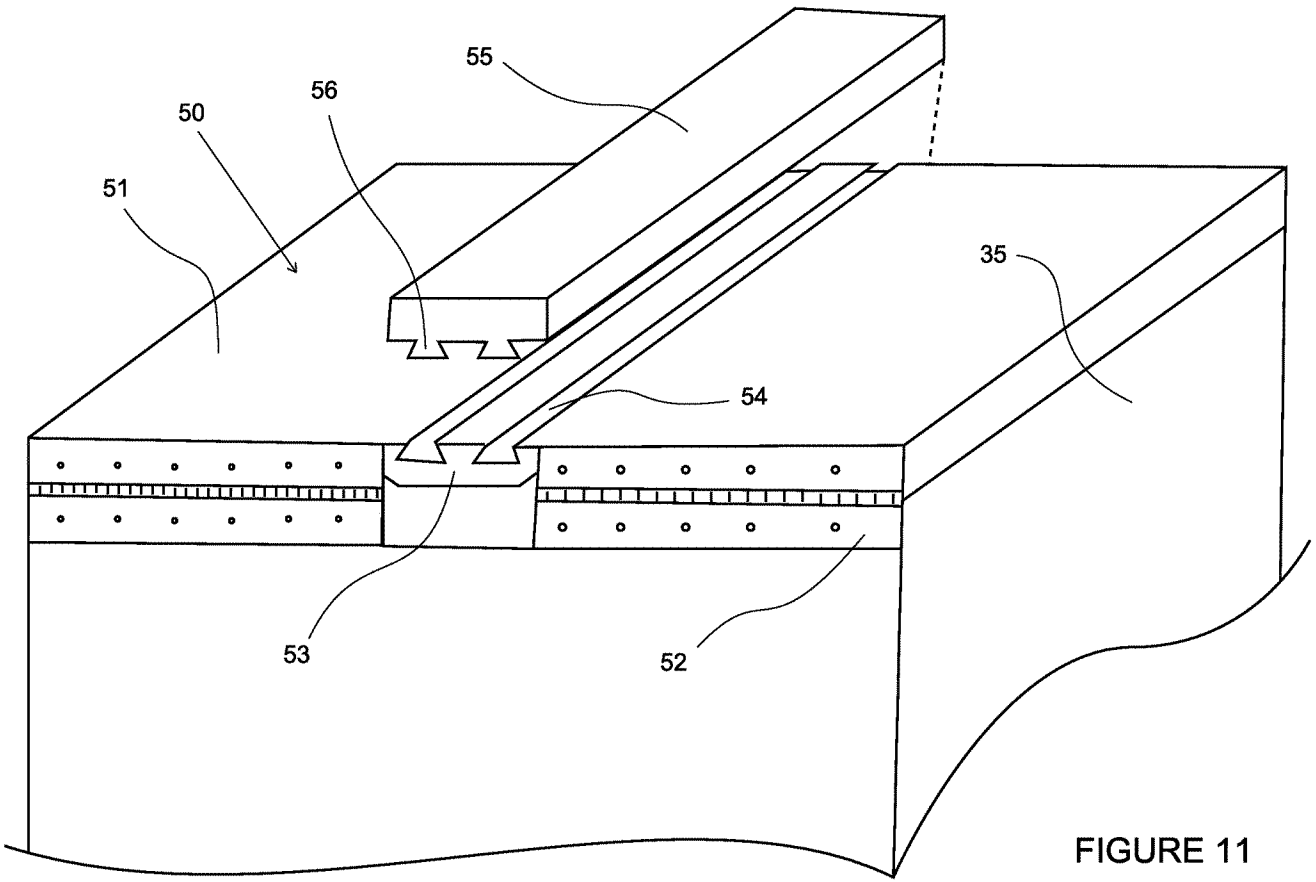
FIG. 11 details a slideably removable ladder stop extending the longitudinal length of the top of the box of FIG. 1.
Figure 12:
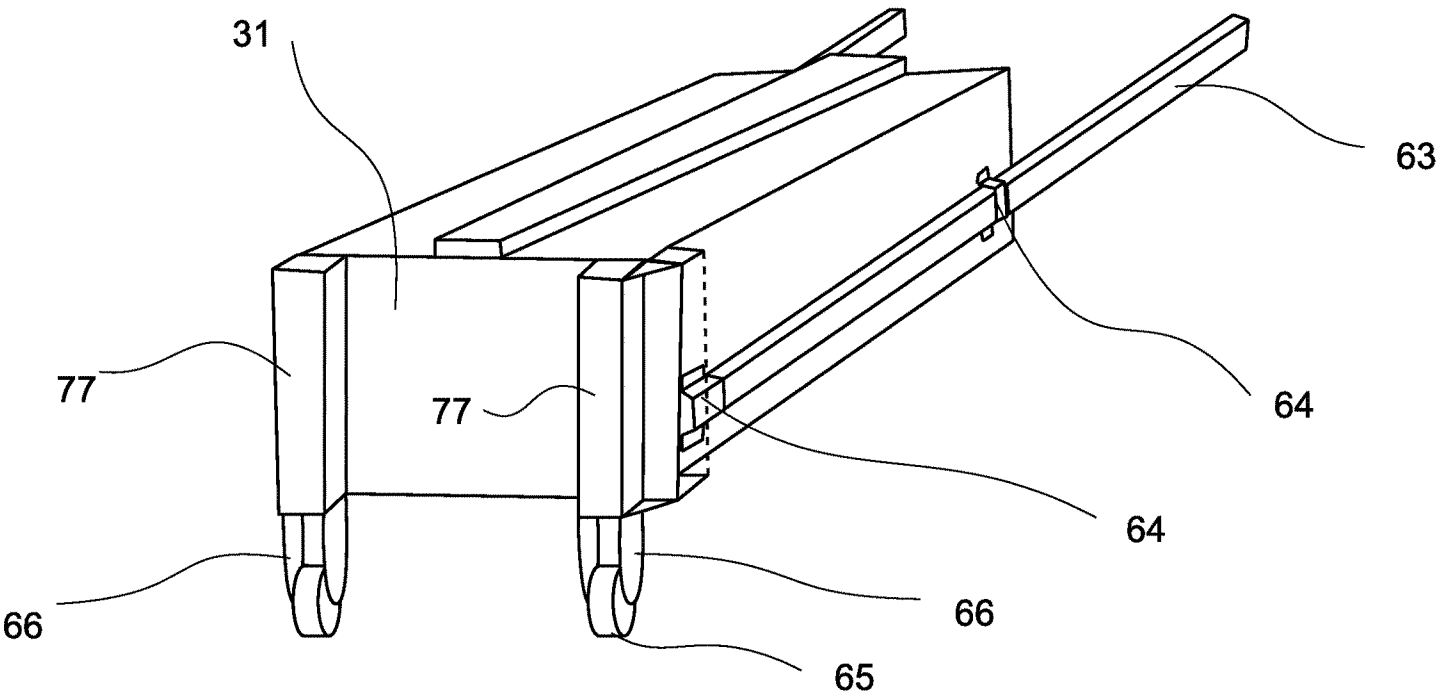
FIGS. 12-13 detail handles and extendable castors coupled to the box of FIG. 1 and adapted to assist in moving the box around the roof or on the ground.
Figure 13:
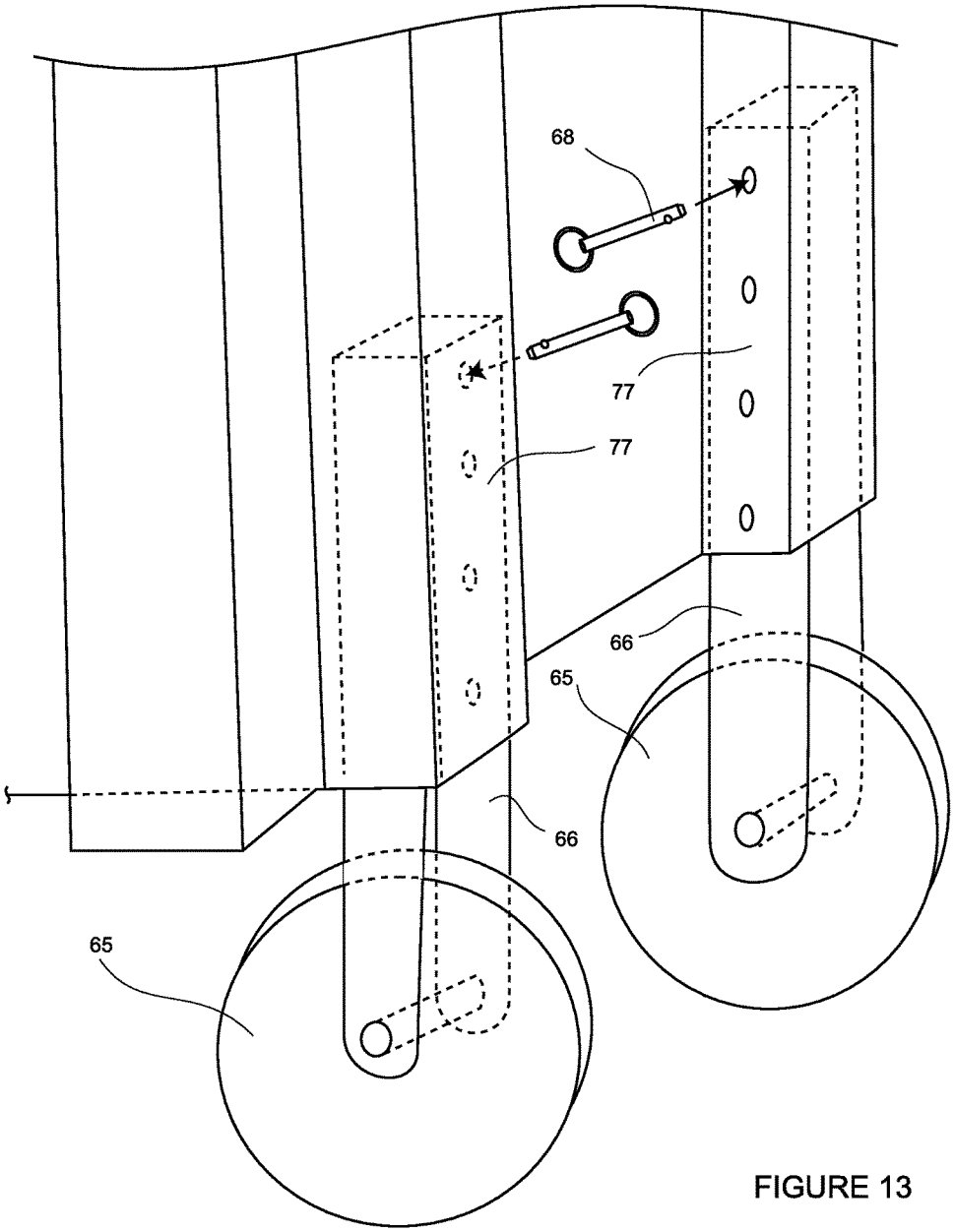
Figure 14:
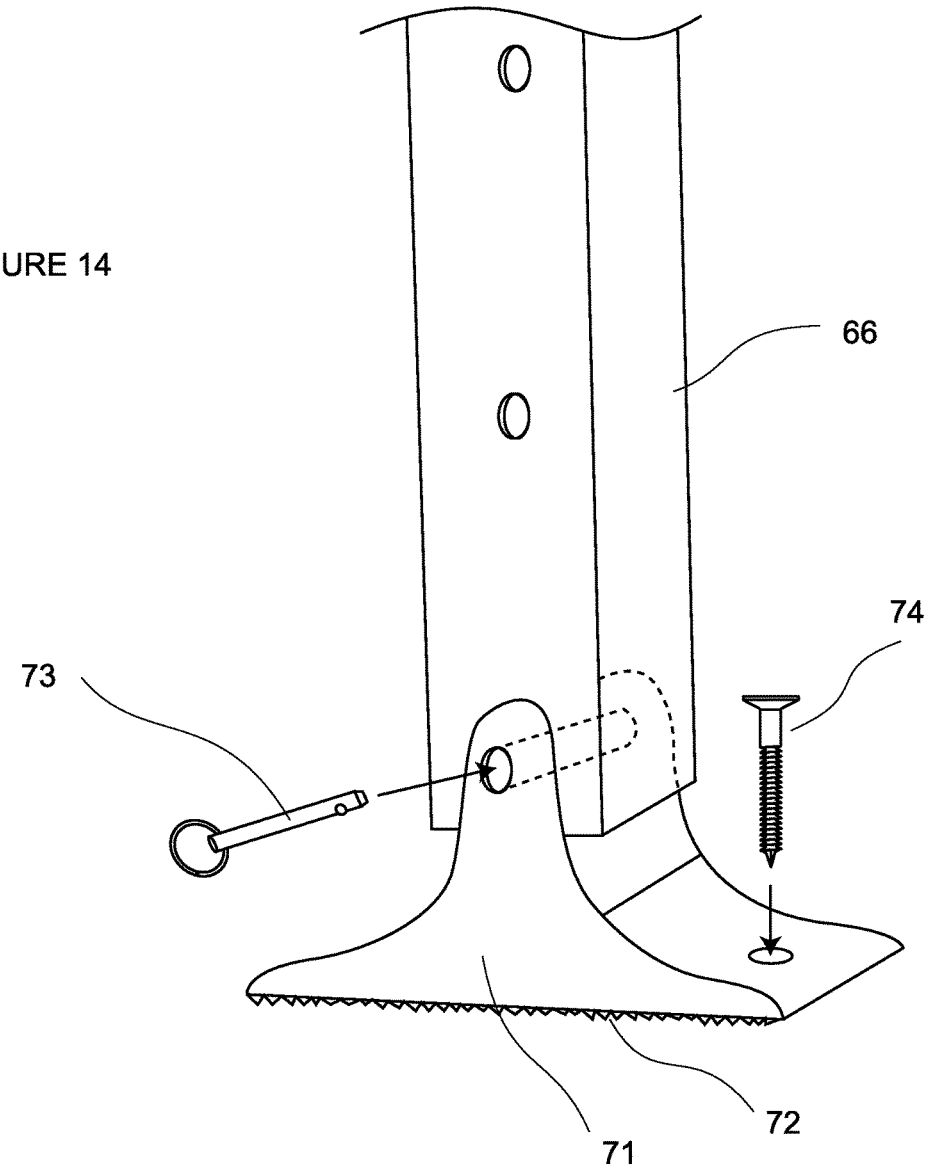
FIG. 14 details a pivot foot on the leveling legs of the box of FIG. 1.
Figure 15:
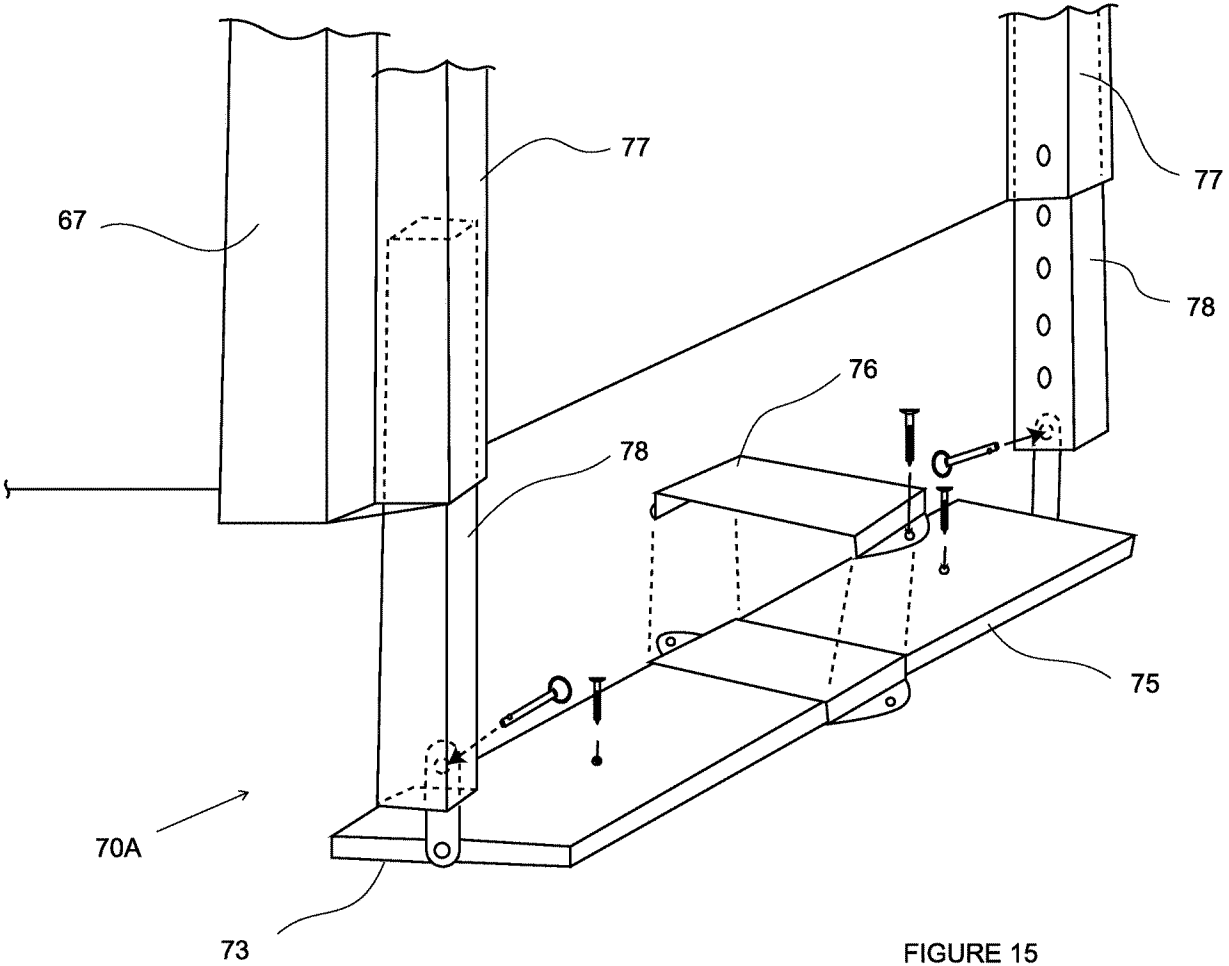
FIG. 15 details a safety support brake disposed on the front, downhill end of the box of FIG. 1 and adapted to further secure the box in place and retard any overturning under load.

Referring first to the figures, and particularly to FIGS. 1-6B, the present invention comprises utility box 30 having a substantially rectangular plan shape but bearing trapezoidal side walls 35,36 descending from flat top 34 and extending longitudinally between rectangular end walls 31, 32 having different heights. The result is a flat-topped utility box 30 that has a sloping bottom 33.

Preferably, the change in height between the bottom of rear, uphill end wall 32 and front, downhill end wall 31 matches the pitch of a typical sloping roof 3, so that simply placing utility box 30 on its bottom of such roof 3 causes top 34 to be level. Still more preferably, the pitch of said typical sloping roof 3 is the minimum pitch for shingled roofs, or approximately a one-in-four (¼) pitch.

Turning now also to FIGS. 12-15, for steeper roofs 3, utility box 30 includes leveling legs 66 journaled within correspondingly shaped vertical leveling channels 67 disposed at the corners formed by front end wall 31 and each of sides 35, 36. Borne on the bottom ends of leveling legs 66 are swivel footers 71 adapted to rotate about foot swivel pin 73 in a plane parallel to the pitch of roof 3. Bottoms 72 of footers 71 thus bear flatly against roof 3 despite the angle between legs 66 and roof 3. Bottoms 72 preferably carry friction enhancing means such as lateral teeth, spikes, lugs or simply a rough, frictional surface (none shown) to optimize stability of box 30 and to deter it from sliding on roof 3.

Leveling legs 66 articulate between a retracted position (not shown) wherein footers 71 do not engage roof 3, and one of an plurality of extended positions wherein footers 71 engage roof 3 to elevate downhill end 31 of box 30 and level top 34. Leveling leg pins 68 extend through holes in channels 67 that have been aligned with similar holes through legs 67 to affix legs 66 in position relative to channels 67. By adjusting legs 66 between positions within channels 67, user 1 (FIG. 1) can level top 34 so that he has a horizontal surface on which to work.

Also coupled to front wall 31 adjacent its corners with sides 35, 36, two additional, vertical channels 77 extend substantially the vertical height of front wall 31 from just below top 34 to just above bottom 33. Journaled within channels 77, caster legs 70 extend from the bottoms of channels 77 and terminate in swivel casters 65 adapted to bear the weight of box 30 when leveling legs 66 are fully retracted and box 30 is lifted by handles 63 (see also FIG. 12). In such configuration, box 30 easily may be maneuvered into position on roof 3 or around on the ground like a wheelbarrow. Caster legs 70 bearing casters 65 may be removed and stowed within interior 37 of box 30 when it is in position on roof 3.

Further securing box 30 in place, and as a safety measure to stabilize it from lateral and overturning forces which may be applied during use or from wind loading, safety anchor 70A comprises wide footer 75 extending between vertical anchor legs 78 which mate with caster channels 77 in place of caster legs 70. Wide footer 75 pivots on joints 73 in a plane parallel to the pitch of roof 3, similarly to leveling leg footer 71, to present a flat bottom surface of wide footer 75 into contact with roof 3, also similarly to leveling leg footer 71. Further, wide footer 75's bottom surface may bear the friction-maximizing means discussed for the bottom of leveling leg footer 71. As further securing means, however, anchor bracket 76 may be provided to surround and engage wide footer 75 and anchor it to roof 3 using nails, screws or other pinning means.

Figure 16A:
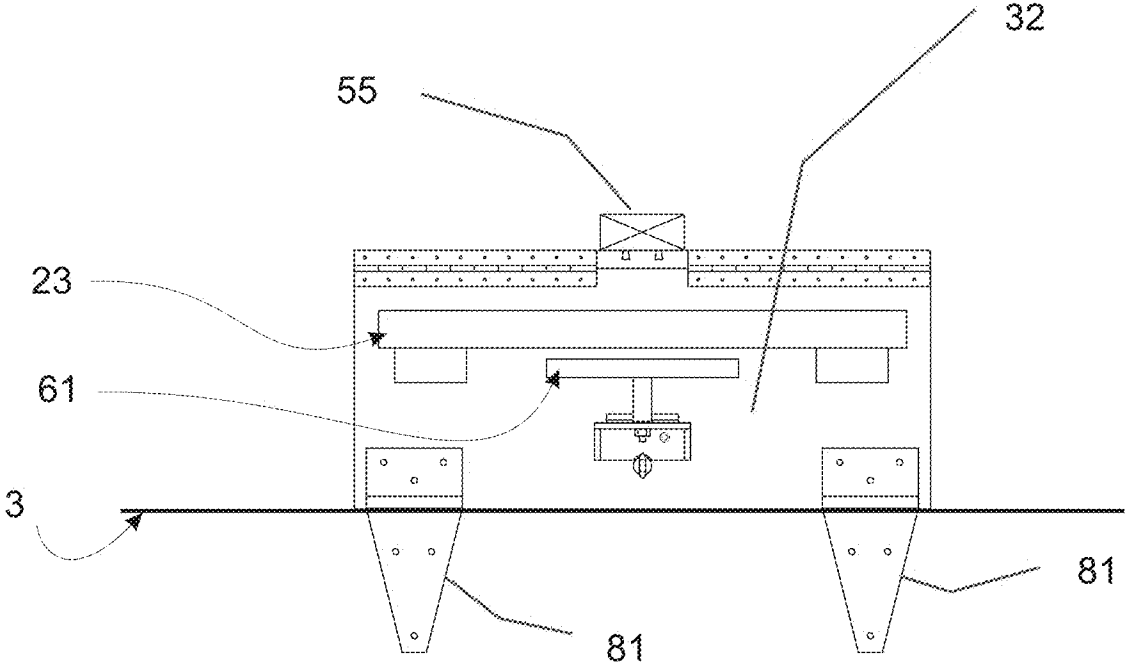
FIGS. 16A-17 detail the uphill end securing means for the box of FIG. 1.
Figure 16B:
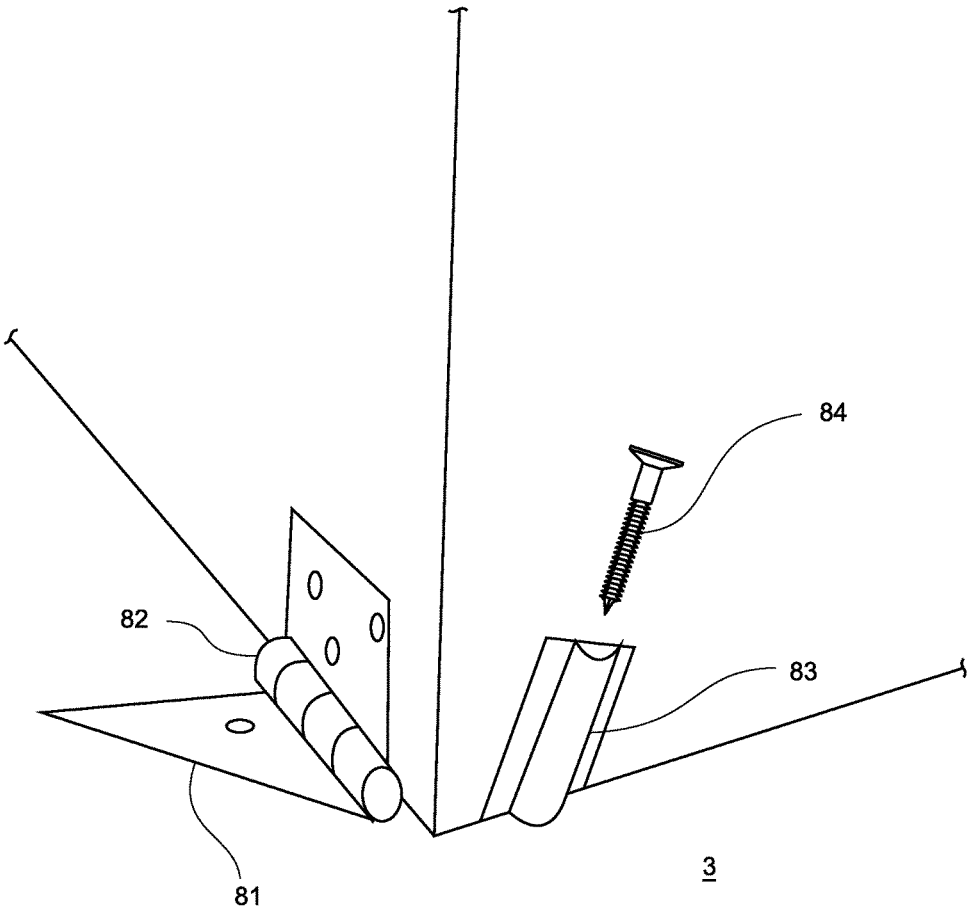
Figure 16C:
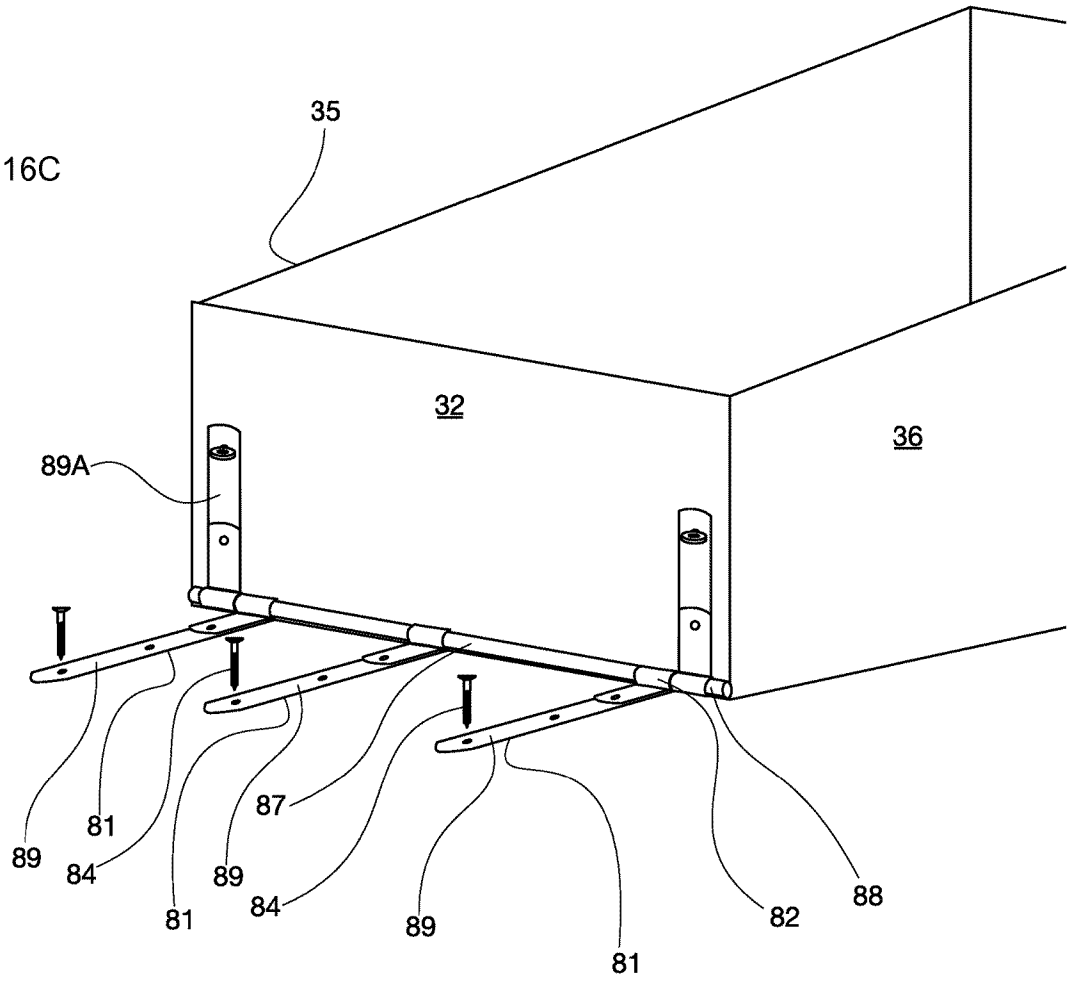
Figure 17:
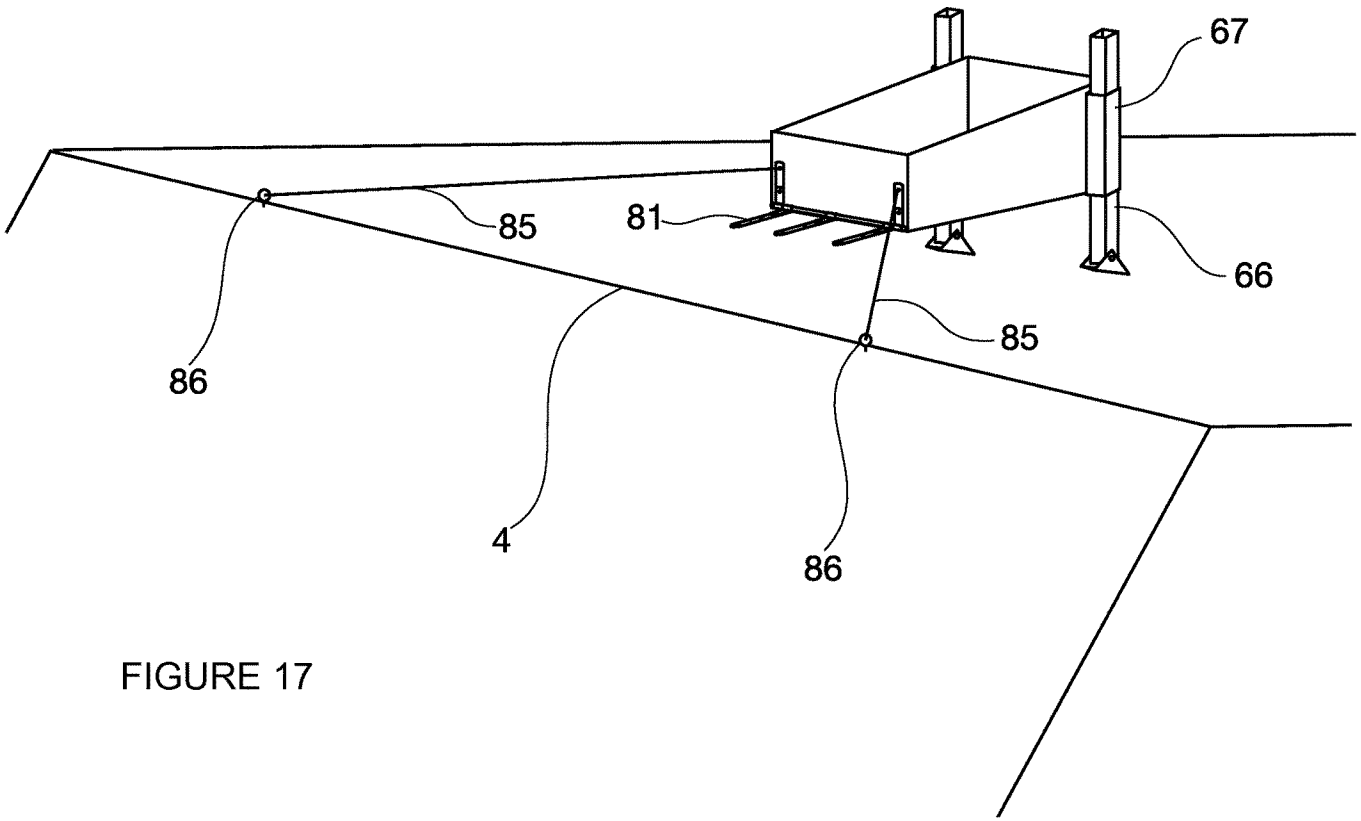

Turning now also to FIGS. 16A-17, additional means for securing box 30 in place include upper anchors 81 coupled to uphill end wall 32 anchor box 30 directly to roof 3 at its uphill end. As depicted in FIGS. 16A-16B, anchors 81 comprise hinges with one of their flanges bolted to rear wall 32 of box 30 and their other flanges extending longitudinally upward from box 30 and to lie flat on roof 3, where they are secured by nails, screws or other pinning means. When not in use, the extended hinge flanges can pivot upward and lie against their attached flanges adjacent rear 32 of box 30. Optionally, locking bracket 83 also may be employed, mounted on sides 35, 26 adjacent their corners with rear wall 32. Locking brackets 83 comprise simple tubular channels through which spikes 84 protrude into roof 3, thereby pinning box 30 to roof 3 and resisting overturning forces.

In FIG. 16C, an alternate embodiment comprises transverse tube 87 disposed at the corner of box 30 formed by rear wall 32 and bottom 33. Extending through transverse tube 87 and beyond sides 35,36 of box 30, transverse rod 88 includes on each of its distal ends apertures through which locking pins 84 extend to attach transverse rod 88 to roof 3, similarly to locking bracket 83 and pin 84 shown in FIG. 16B.

Disposed along the length of transverse tube 87 appear gaps wide enough for anchor flanges 89, which, when deployed, lie adjacent roof 3 and are secured to roof 3 by nails, screws or other pinning means, as discussed above for hinges 81. In this case, however, flanges 89 do not include mating flanges that are attached directly to rear 32 of box 30, but instead are attached to box 30 by transverse rod 88 and transverse tube 87. Since transverse rod 88 extends through the wide end of flanges 89 adjacent rear 32, flanges 89 also pivot around transverse rod 88 to lie against rear 32 and to be held in place by latches 89A.

As depicted in FIG. 16C, transverse tube 87 is mounted onto the surface of rear 32 and flush with bottom 33 so that it protrudes longitudinally rearward from box 30 but not downwardly past bottom 33. This prevents transverse tube 87 from interfering with the stabilizing effect of friction between bottom 33 and roof 3. One having ordinary skill in the art will recognize, however, that transverse tube 87 may instead be recessed into rear 32 such that it is flush with both bottom 33 and rear 32. In such case, flange 89 preferably would be recessed into rear 32 when it is folded upwards to be held in place by latch 89A. Alternately, flanges 89 could be replaced altogether with hinges 81 as discussed above with FIG. 16B.

Finally, as a fail-safe measure for securing box 30 to roof 3, and particularly while it is being repositioned on roof 3, safety cable or tether 85 (FIG. 17) extends from rear wall 32 to roof ridge 4 where it is secured on the opposite slope of roof 3. In fact, tether 85 can extend beyond ridge 4 (not shown) all the way to the ground on the opposite side of the building, there to be secured to the ground, a fixed object or by other means. Tether 85 also could extend to the eaves (not shown) of roof 3, where reliable purchase may be made at convenient, fixed locations. One having ordinary skill in the art will recognize that all such alternative attachment means for tether 85 are considered within the spirit and scope of the present invention.

Referring also now to FIGS. 7A-11, lid 50, hingedly coupled to rear end wall 32 (see FIG. 11), comprises closure of box 34 at its top 34. Lid 50 may be lifted by its front end juxtaposed front wall 31 into a substantially vertical position (See FIG. 3) to provide access to interior 37 of box 30, which may contain materials or tools (not shown) or useful items such as slidable tray 41 or ice chest 12. Disposed within lid 50, channel 53 provides means by which ladder stop 55 may be removed to clear top surface 51 of lid 50 for user 1 to use surface 51 as a flat work surface. Dovetail lugs 56 extending at least a portion of the length of ladder stop 55 on its bottom surface juxtaposed surface 51 mate with dovetail grooves 54 to secure ladder stop 55 to lid 50 yet permit it to be removed when surface 51 is needed as a work surface. The purpose of ladder stop 55 is discussed in more detail below.

Secured to sides 35,36 and ends 31,32 of box 30 are a number of external utility devices for the convenience of user 1. As best seen also in FIGS. 7A-10B, said convenience devices supplement and keep free top 34 for working materials by storing tools and supplies within easy reach without user 1 having to bear them on his person or reach into interior 37 to retrieve them. For example, FIGS. 3-5, 9A-10B show side utility trays of various depths coupled to sides 35,36 by tongue 24 adapted to journal within slot 25 affixed to sides 35,36 at a convenient location below top 34. Preferably, slots 25 are positioned vertically on sides 35 such that the upwardly opening mouths of trays 23 are substantially flush with surface 51 of top 34, thereby extending the usable area of top 34 should user 1 wish to do so. One having ordinary skill in the art will recognize, of course, that slots 25 may be affixed at any number of vertical positions along sides 35 without departing from the spirit and scope of the present invention. In fact, multiple slots 25 could be positioned on sides 35, 36 (not shown) to provide alternative locations for user 1 to attach trays 23 to box 30.

Similarly to trays 23, special purpose platforms 26,28 couple to front end wall 31 to provide a flat work surface when ladder stop 55 remains in place and surface 51 is not available for such use. This could occur, for example, when ladder stop 55 is used to secure ladder 16 to box 30, so that user 1 may climb up above roof 3 to work, as discussed in more detail below. Platforms 26, 28 mount to box 30 using the top, open ends of caster leg channels 77. Platform pegs 27 journal within channels 72 from adjacent top 34, while brace 29 extends to engage front wall 31 and reinforce platforms 26, 28. Platforms 26, 28 have been characterized as special purpose extensions for use by carpenters and roofers specifically, but one having ordinary skill in the art will recognize that platforms 26, 28 may be adapted for use by other users 1, such as painters, without departing from the spirit and scope of the present invention.

Figure 18:
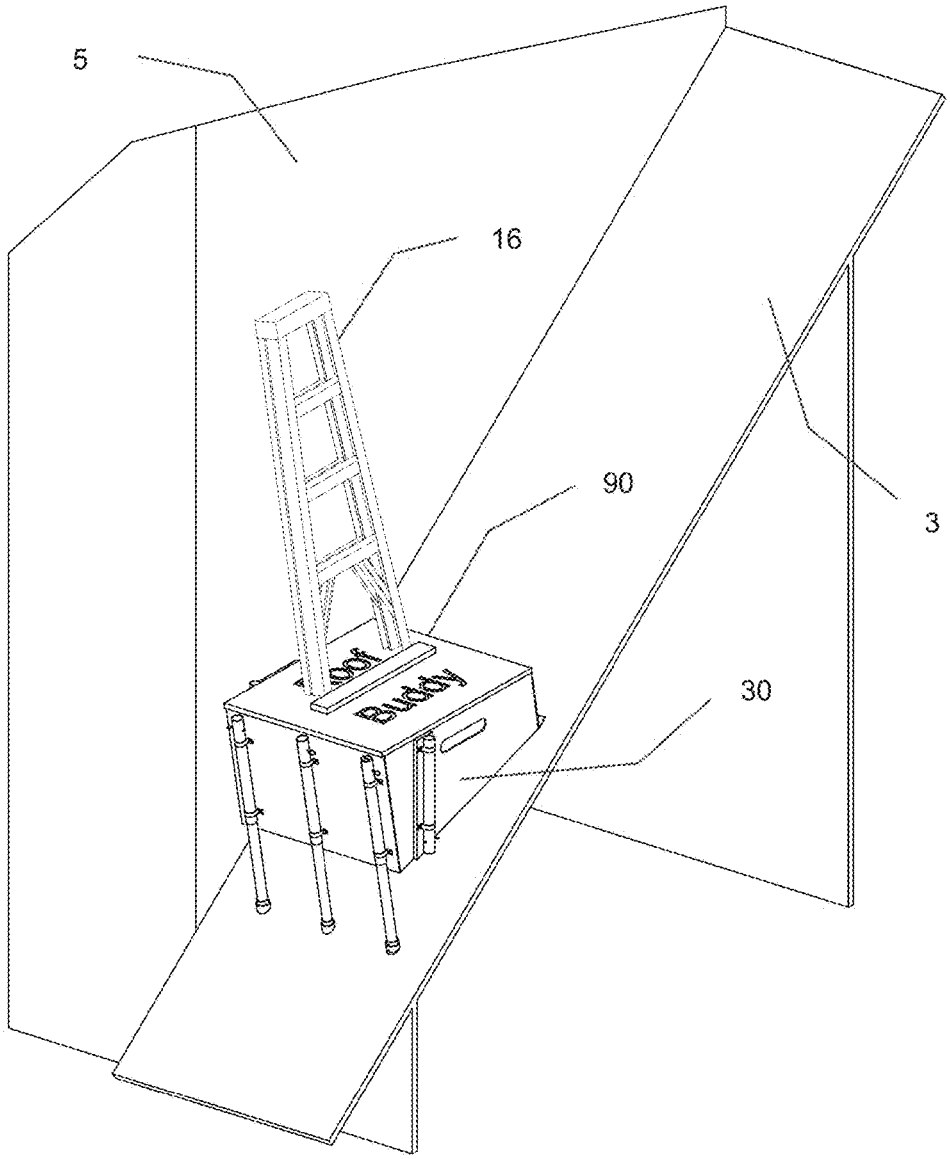
FIGS. 18-20 illustrate and detail use of the box of FIG. 1 as a platform for securely erecting a ladder.
Figure 19A:
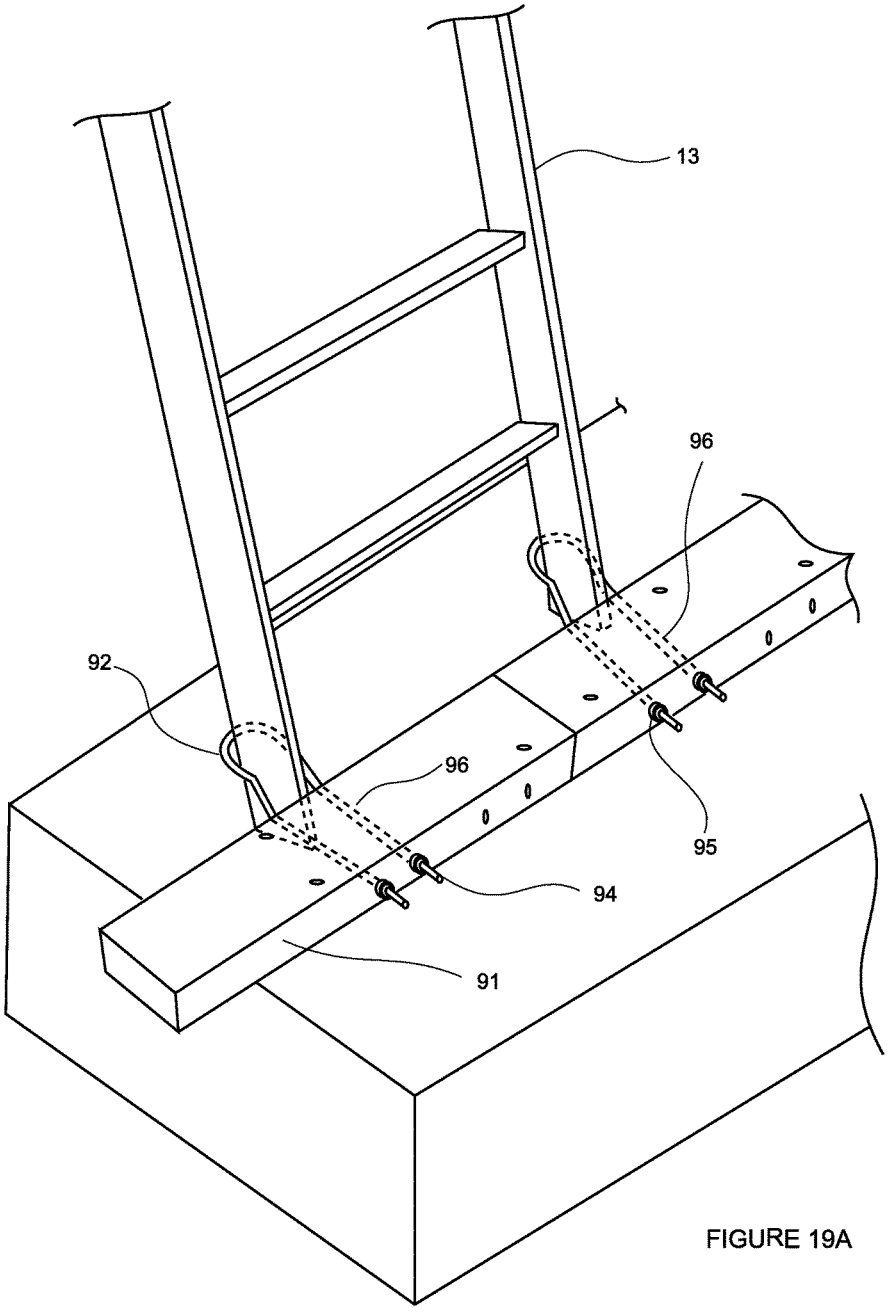
Figure 19B:
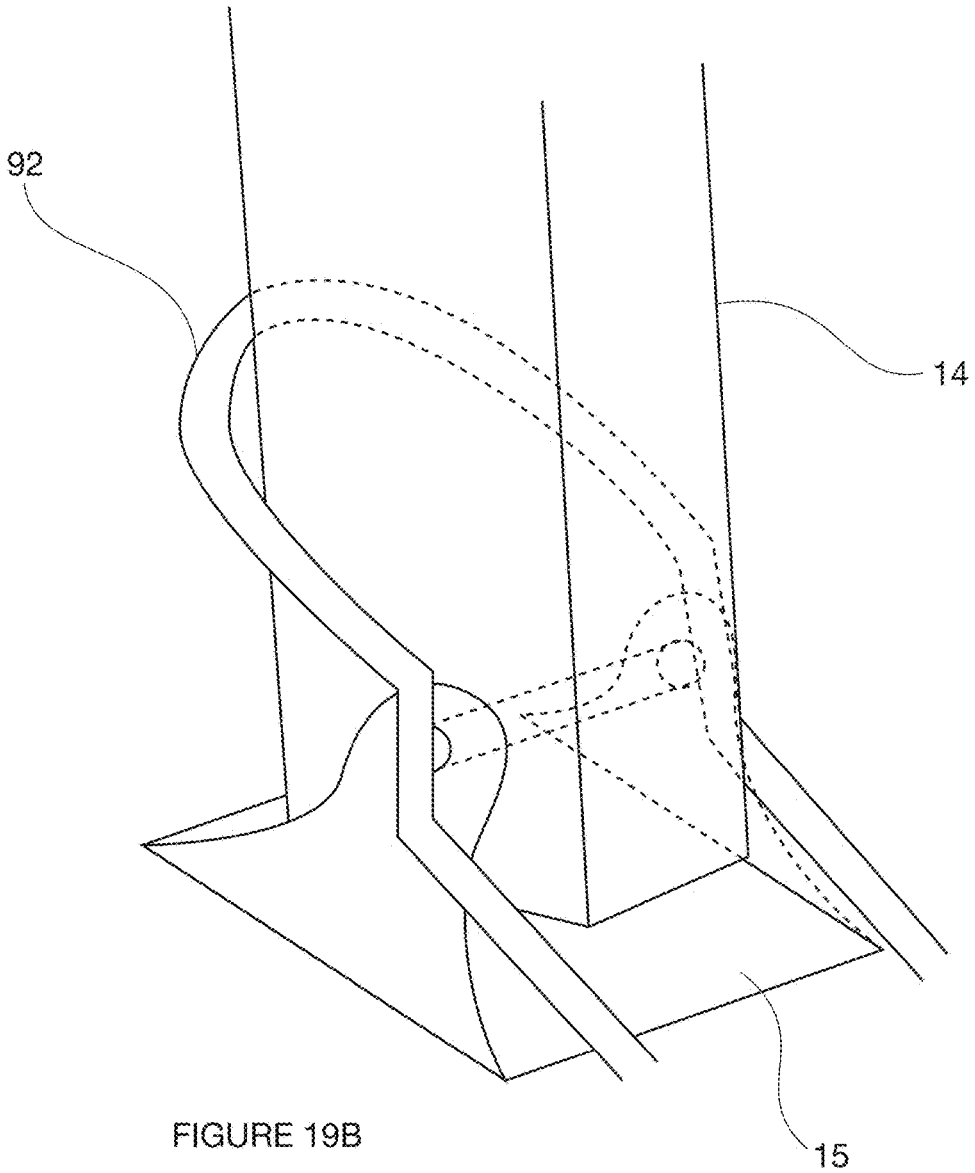
Figure 20:
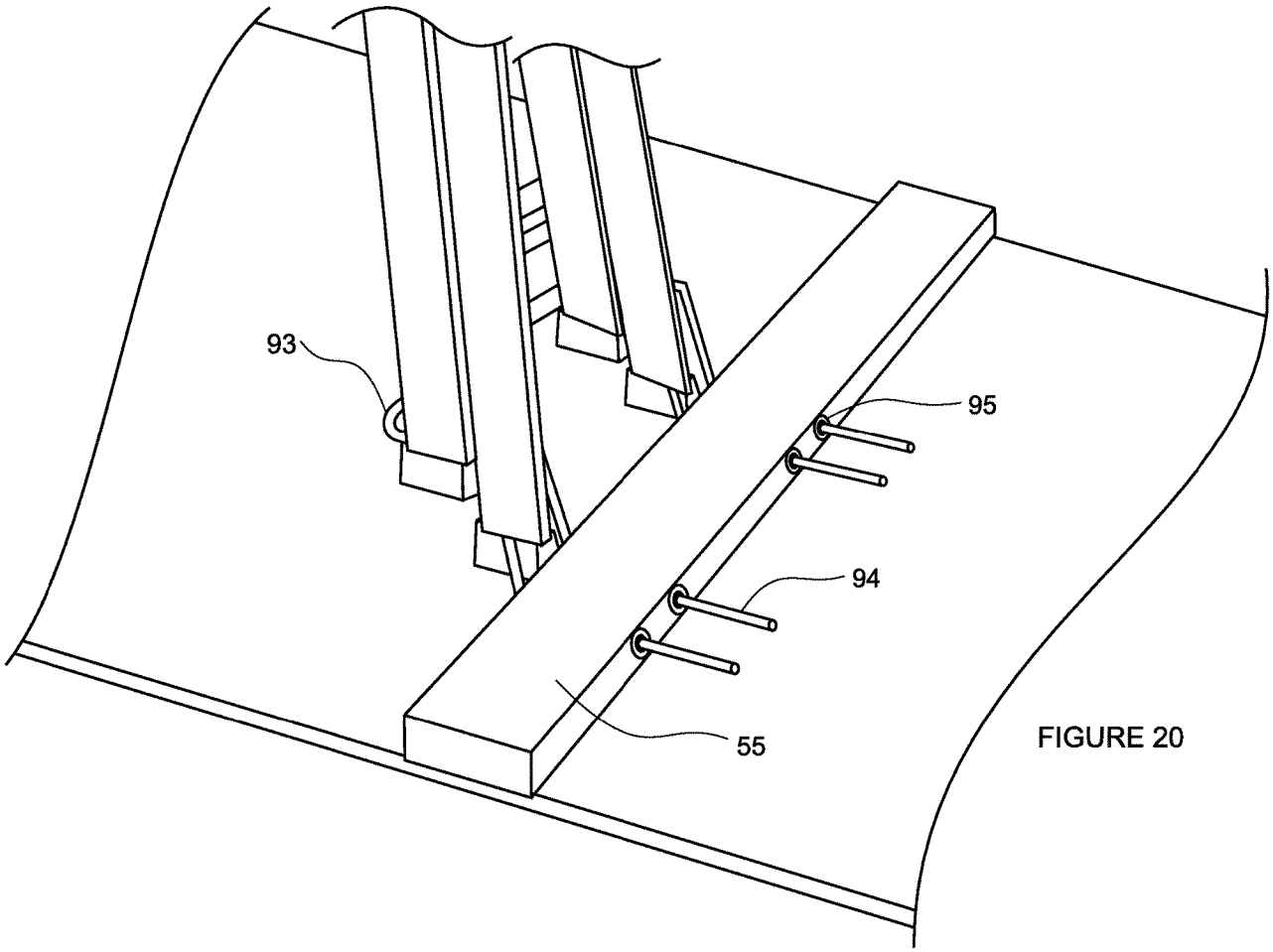

Turning now also to FIGS. 18-20, utility box 30 is shown in use to secure ladder 16 to roof 3 so that user 1 may reach higher places, such as the top of dormer 5, otherwise out of his reach. It is exceedingly difficult to reach such elevated places while standing on roof 3. Some work, such as painting with rollers, can be achieved by using tools with extended handles (not shown), but some work demands that user 1 be within arms' reach.

Trying to use a ladder on a sloping roof 3 is exceedingly unsafe. Ladders are designed to have their legs substantially upright, and their rungs horizontal, so that the ladder's centerline is vertical and its center of gravity, and that of a user 1 or other loads, is positioned between the ladder's supporting feet. But roof 3 does not provide a horizontal surface onto which to rest ladder 16's feet such that its centerline is vertical. Though its uphill foot can engage roof 3, its downhill foot will be suspended in the air and unable to support any weight, even that of ladder 16 itself. On gentle pitches, user 1 might be able to get ladder 16 to rest at an angle, substantially perpendicular to roof 3, but user 1's weight will necessarily be stationed at the top of ladder 16 where it leans against dormer 5, creating a dangerously unstable situation. Shimming ladder 16's downhill foot so ladder 16 is level is equally unsatisfactory, because the forces bearing down onto such shimming would tend to overturn it, undermining the support of ladder 16. Anchoring ladder 16 to dormer 5 at its top does not provide a safe alternative, because ladder 16's feet still would not be under the center of gravity of ladder 16 loaded with user 1 and his tools and materials. Thus, without box 30 used as described herein, user 1 must erect expensive scaffolding so he can work at heights elevated above roof 3.

As seen in FIG. 18, box 30 may be positioned adjacent dormer 5 and secured in place as discussed above. This includes having ladder stop 55 in place, with its lugs 56 journaled within grooves 54 such that ladder stop 55 cannot move relative to box 30. Ladder 16 then can be placed with its feet resting against ladder stop 55 and its head resting against dormer 5 and in a safe position to reach the upper levels of dormer 5 from ladder 16. As a further security measure, not only to guard against ladder 16's feet slipping longitudinally along ladder stop 55, but also to guard against overturning forces pivoting ladder 16 on one of its feet and toppling over, ladder stop 55 includes ladder braces 92. Braces 92 comprise elongate U-bolts that surround the feet of ladder 13 and extend through tunnels 96 bored through ladder stop 55 to terminate in threaded ends 94 secured by nuts 95. When tightened, braces 92 affix ladder 13's legs 14 to ladder stop 55, which in turn is secured to utility box 30, preventing ladder 13 from overturning. For a step ladder 16, which has two sets of legs 14 that must be secured, braces 92 include an elongate offset 93 which reaches the second set of step ladder 16's legs and secures them in similar fashion. One having ordinary skill in the art will recognize that various configurations of braces 92 may be employed for different types of ladders 13, 16 without departing from the spirit and scope of the present invention.

Figure 21:
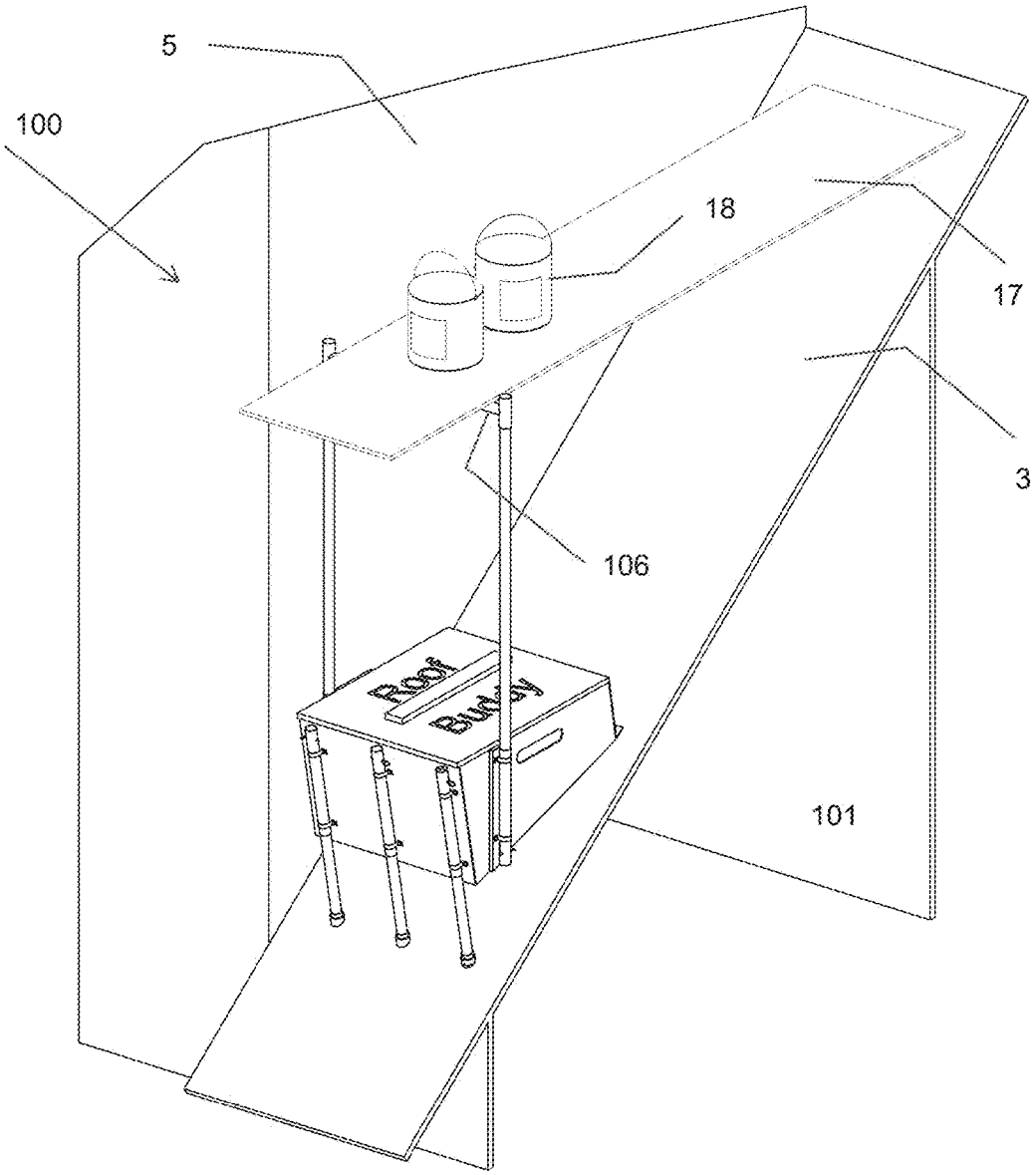
FIGS. 21-23 illustrate and detail use of the box of FIG. 1 for erecting scaffolding.
Figure 22:
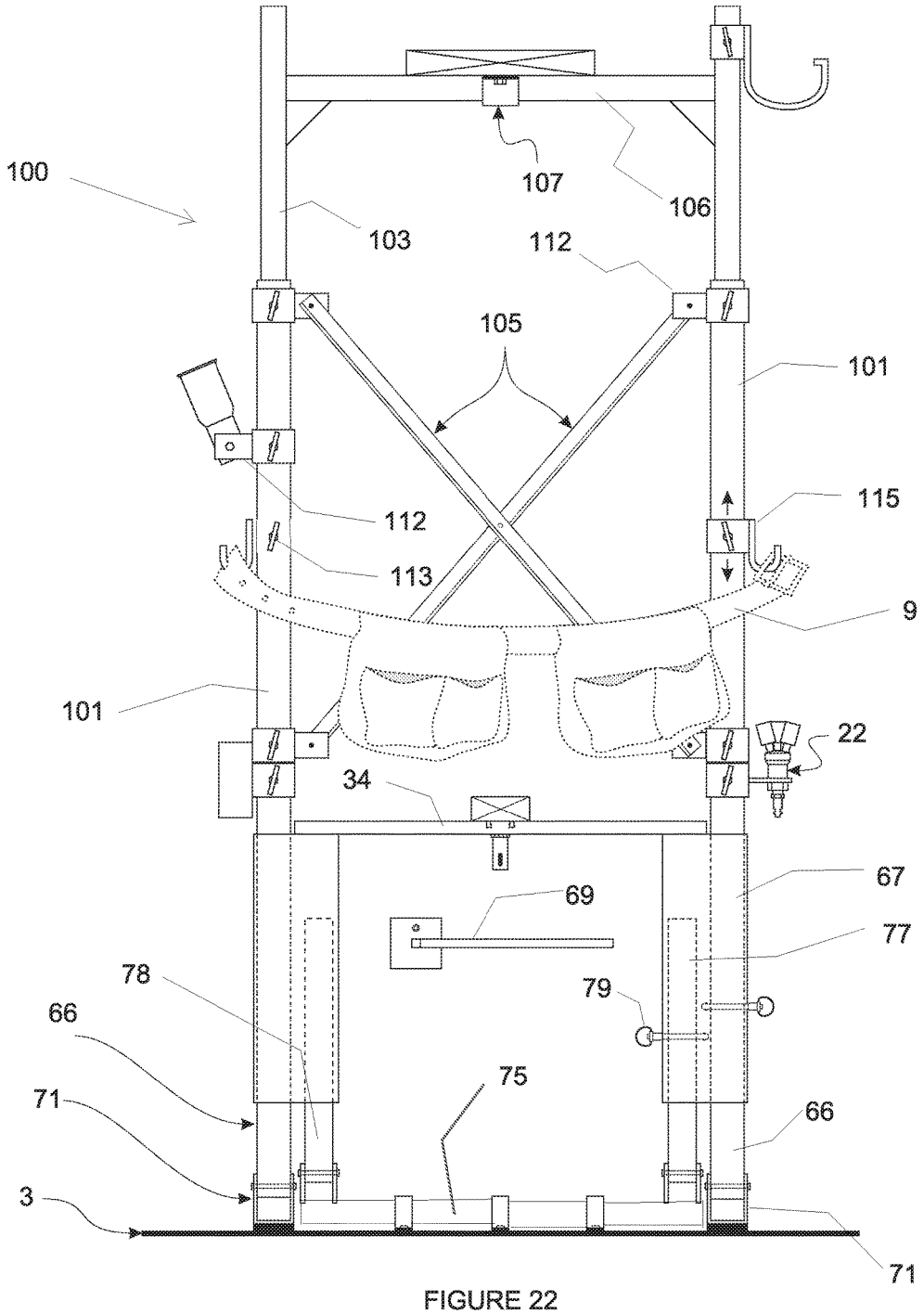
Figure 23:
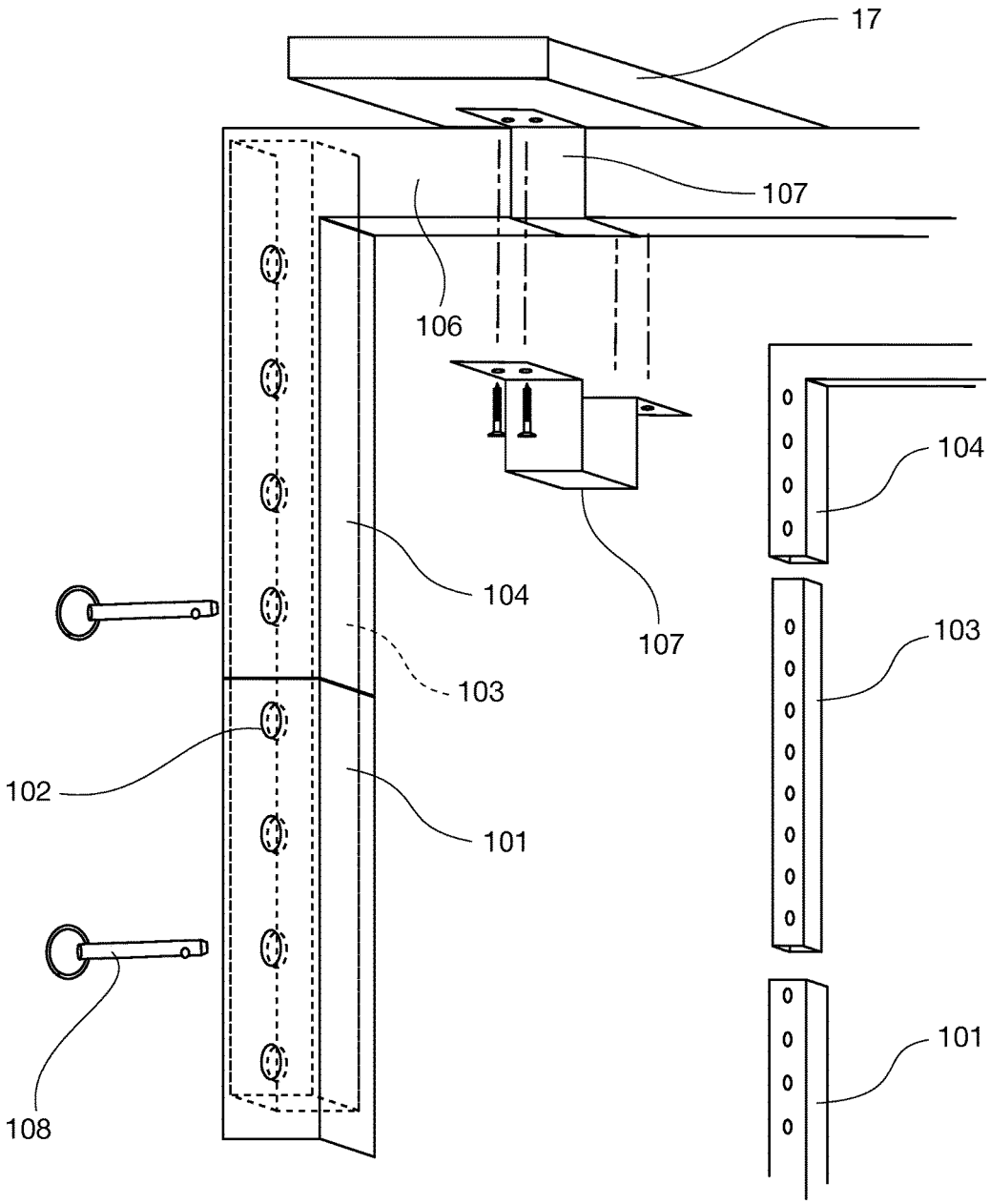
Figure 24:
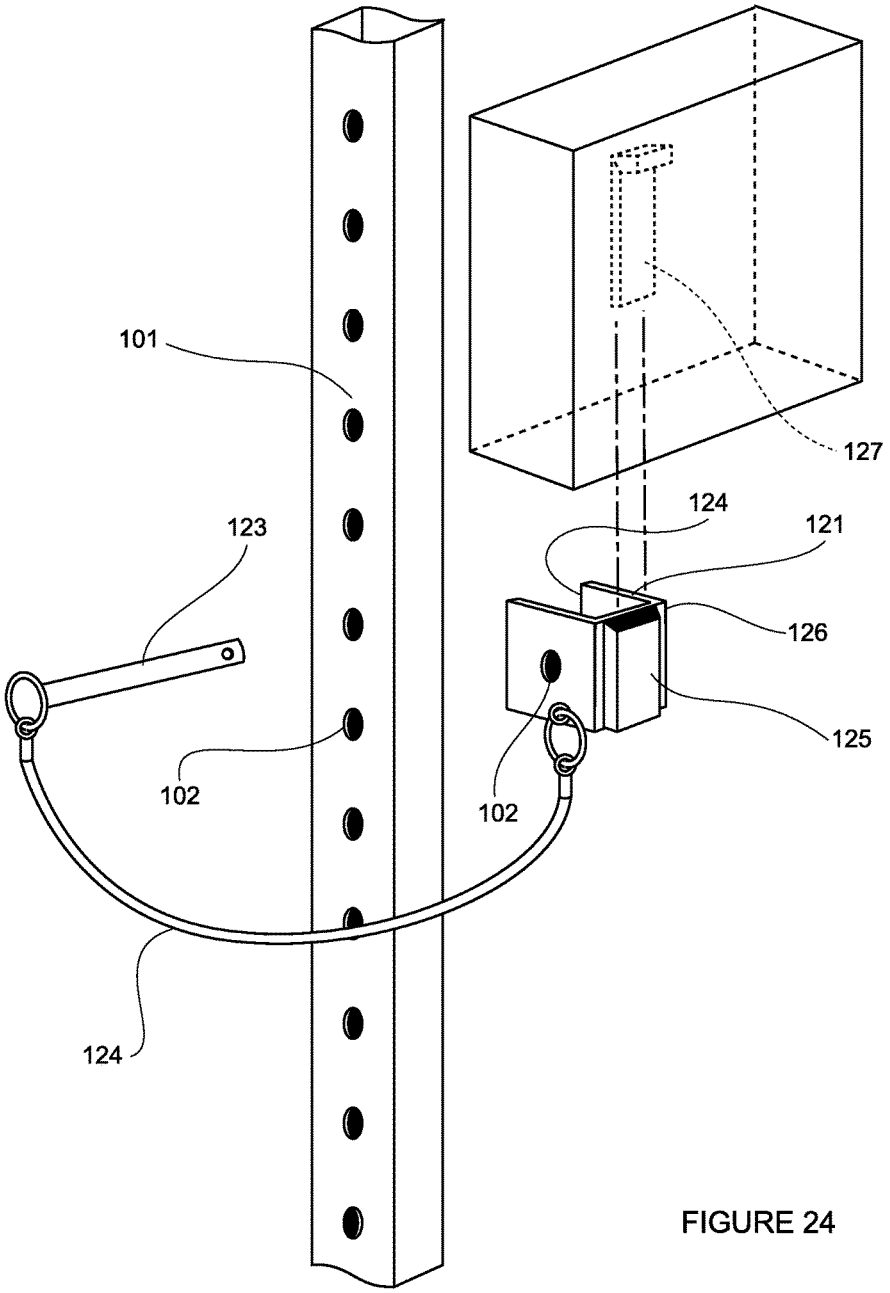
FIGS. 24-27B detail attachments for coupling utility devices to the masts of the scaffolding depicted in FIGS. 21-23 on the box of FIG. 1.
Figure 25:
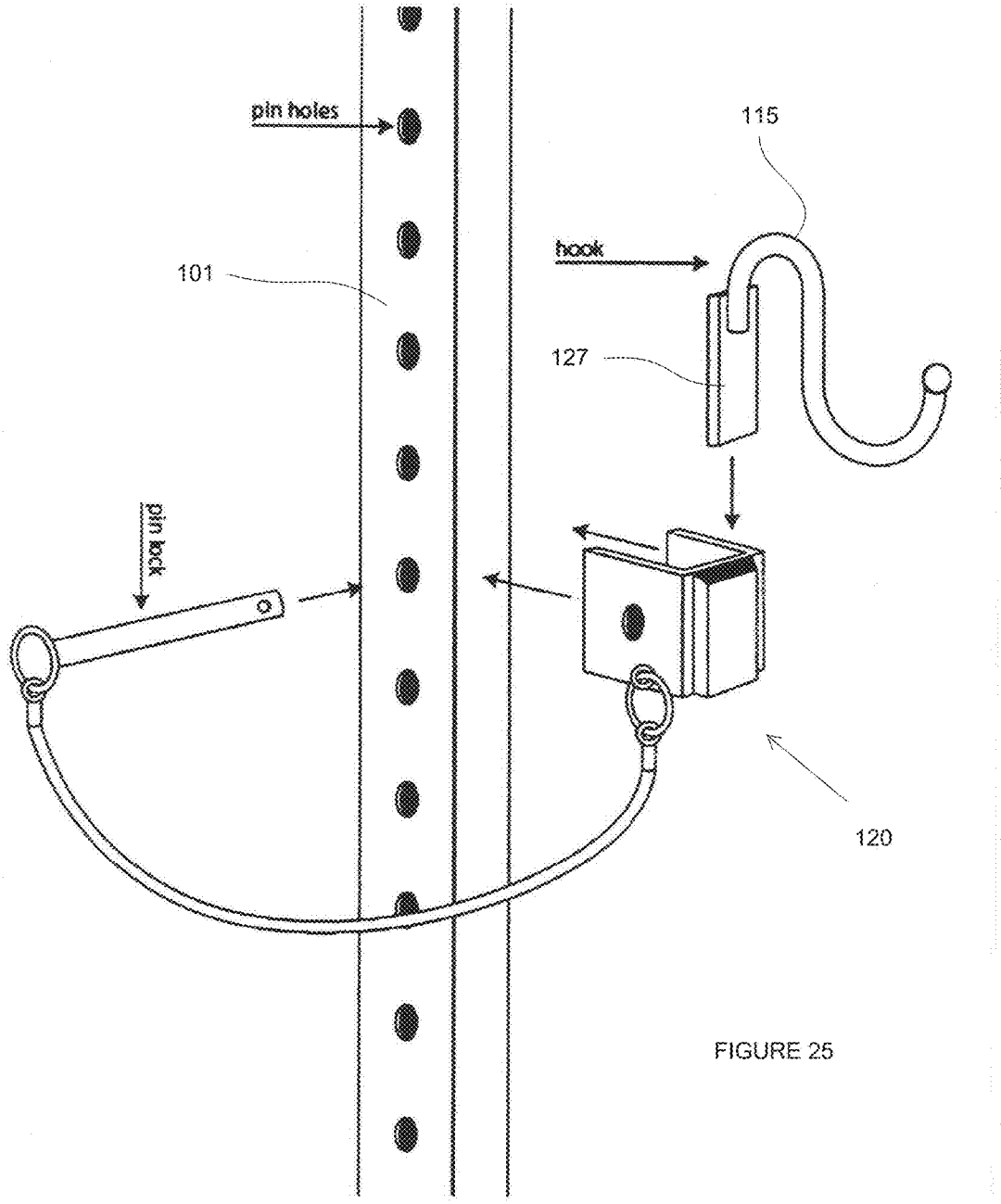
Figure 26B:
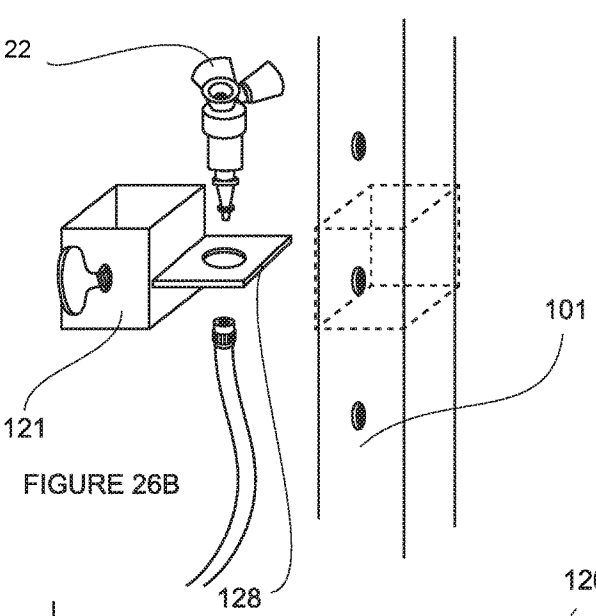
Figure 26A:
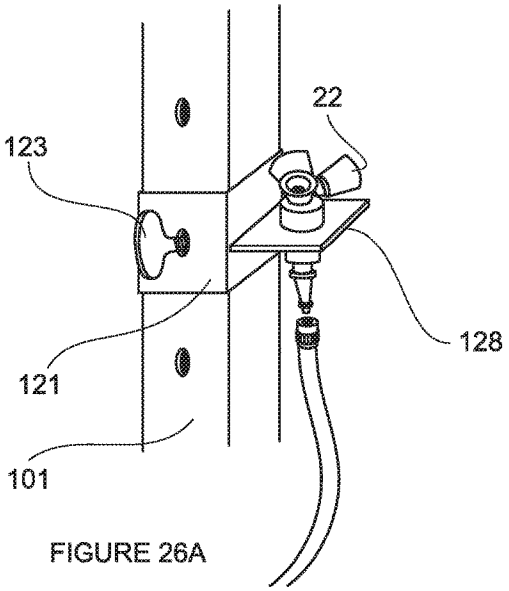
Figure 27B:
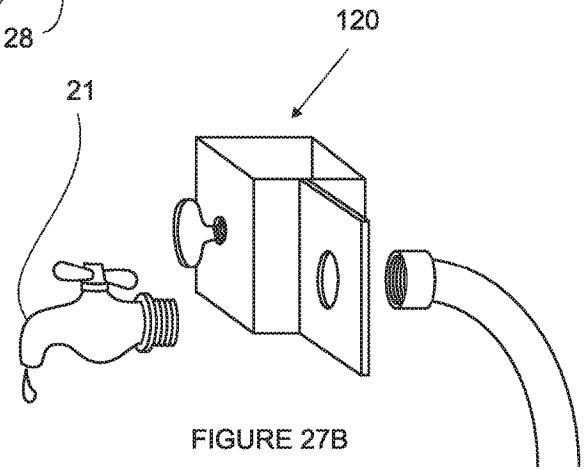
Figure 27A:
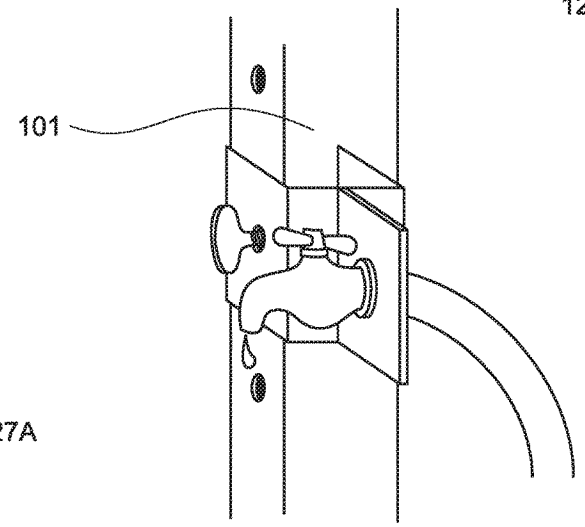

Turning now also to FIGS. 21-23, sometimes ladders 13, 16 simply are inadequate for the job, and scaffolding is required. This could be because more than one person must be elevated, or because a large amount of materials or equipment must accompany user 1. As depicted in FIG. 21, masts 101 extend vertically upward from box 30 and are coupled together near their top ends by yard arm 106 to provide a support for scaffolding plank 17 resting by one end on yard arm 106 and the other end at the same elevation directly onto roof 3. As best seen in FIGS. 22, 23, clamp 107 surrounds yard arm 106 and is secured into plank 17 by nails, screws or the like so that, once it is located properly, it cannot slide across yard arm 106, and away from roof 3 at its other end. Thus, it is affixed into a horizontal position once it is attached to yard arm 106.

Masts 101 are secured to box 30 by their bottom ends which are journaled into the top ends of leveling leg channels 67. Masts 101 extend upward therefrom a fixed distance and are reinforced by X-bracing 105 against compressive and overturning forces which otherwise might cause masts 101 to flex or buckle under load. X-braces 105 slideably couple to masts 101 by flanges 112 affixed to slideable collars 111 which surround masts 101 and may be affixed in a vertical position using set-screw handles 113.

Telescopically extending upwards from the upper ends of masts 101, mast extenders 103 enable user 1 to adjust the height of yard arm 106 without moving leveling legs 66 and repositioning other securing means, such as wide footer 75. Yard arm 106 couples directly to sheath 104 (see FIG. 23) which telescopically extends over extender 103, and pins in place by mating transverse pin holes and pins 108 extending through sheath 104 and extender 103, as well as through masts 101. Thus, the outer diameter or dimensions of sheath 104 are substantially the same as that of masts 101, which provides some conveniences discussed in more detail below. By affixing yard arm 106 to a separate leg (sheath 104) and mating it to masts 101 using extender 103, yard arm 106 remains removable when user 1 uses box 30 without needing any scaffolding.

Turning next to FIGS. 24-27B, accessory attachment means 120 comprises C-channel collar 121 open on its mouth side 122 and adapted to removably engage mast 101 or sheath 104 and to be pinned thereto by keeper pin 123 secured to collar 121 by tether 122. Disposed on its middle face opposite mouth 122, vertically disposed attachment channel 125 receives lug 127 disposed on accessory 130 such as an electrical box, J-hook 115 or the like. User 1 conveniently and easily may position accessory 130 up and down both masts 101 and sheath 104 by removing pin 123, removing collar from mast 101 or sheath 104 through mouth 124, and relocating it to another position along mast 101 or sheath 104. This is a great improvement over closed collars (not shown) which surround mast 101 or sheath 104 and must be slid upward, off the end thereof, to be removed altogether or to be repositioned on a different mast 101 or sheath 104 or above or below another device attached to mast 101. As best seen in FIGS. 26A-27B, this system also may be used to mount utilities such as pneumatic fittings 22 or water faucets 21 by coupling them to vertical or horizontal flanges 128 disposed on collars 121 in lieu of channels 125.

Box 30 may be fabricated from a number of different materials, including wood, sheet metal or the like, but one having ordinary skill in the art will recognize that any suitable material may be employed as long as it has sufficient strength and durability characteristics. Preferably, box 30 is fabricated from a high-impact molded plastic whereby leveling leg channels 67 and anchor legs channels 77 are molded as one piece with sides 35, 36 and front end wall 31. Also, though depicted in some of the figures as having a circular cross section, preferably, masts 101 and sheaths 104, as well as extender 103 comprise square tubing. This abets use of collar 121 and makes it more stable.

While the invention has been particularly shown and described with reference to preferred and alternate embodiments, it will be understood by those skilled in the art that various changes in form and detail may be made therein without departing from the spirit and scope of the invention.

For example, ladder stop 55 has been depicted and discussed above (e.g. in conjunction with FIG. 11) as ladder bracing means anchored to lid 50 by dovetail lugs 56 on ladder stop 55 cooperating with channel 53. Such ladder stop means instead could comprise a simpler ladder stop 55 comprising a simple 2×4 or 2×6 plank (similar in cross section to depicted ladder stop 55 but without lugs 56) held onto lid 50 by simple U-brackets (not shown).

Further, though braces 92 have been depicted and discussed above (e.g. in conjunction with FIGS. 19A-20) as being U-bolts cooperating with horizontal, transverse bores 96 through ladder stop 55, they just as readily could be simple, slidable shoes (not shown) disposed on ladder stop 55 and adapted to be adjustable along the longitudinal length of ladder stop 55, and also including recesses (not shown) into which the feet of ladder 13 nest while being supported by box 30.

Still further, box 30 has been depicted and discussed as having one pair of leveling legs 66 disposed on two corners adjacent front panel 31, but box 30 also could include similar leveling legs 66 on all four corners (not shown) to maximize leveling options for box 30.

I claim:

1. A roof worker's utility box for use on a sloped roof, said utility box comprising substantially planar front and rear and left and right side walls, each of said walls having top, bottom and side edges, said walls coupled together at their adjacent side edges to form vertically disposed corners; and surround and define a utility box interior;

a bottom coupled to said bottom edge of at least one of said planar front and rear and left and right side walls and disposed substantially directly below said utility box interior, said bottom adapted to frictionally engage said sloped roof;

a substantially planar top hingedly coupled to a top edge of one of said front, rear, left and right side walls opposite said bottom and adapted to close said utility box interior, said planar top further having a longitudinal axis; an exterior top surface; and ladder bracing means disposed on said exterior top surface for bracing a ladder removably supported on top of said utility box;

telescopically adjustable left and right masts extending vertically upward, one each of said left and right masts disposed on one of said two vertically disposed corners adjacent on said front wall, said adjustable masts having X-brace means spanning between said left and right masts for bracing said masts above said planar top;

yard arm means coupled to and spanning substantially horizontally between said left and right masts; and scaffolding means disposed atop and substantially parallel said longitudinal axis for creating a horizontal scaffolding disposed a spaced distance above said planar top; and at least one C-channel collar having a plurality of C-channel vertical walls surrounding a C-channel interior adapted to receive a portion of one of said adjustable masts;

a peg adapted to penetrate transversely through said plurality of C-channel walls and said one of said adjustable masts to secure said C-channel collar in a fixed position relative to said one of said adjustable masts; and a vertically oriented attachment channel disposed on one of said plurality of C-channel walls, said attachment channel adapted to receive a vertically oriented lug disposed on each of a plurality of accessory means for securing said each of a plurality of accessory means to said adjustable masts.

2. The roof worker's utility box of claim 1 wherein said left and right side walls are trapezoidal in shape, having bottom side wall edges diverging at a downward angle from said rear wall toward said front wall, whereby, when said bottom engages said sloped roof, said planar top is disposed substantially horizontally relative to said sloped roof.

3. The roof worker's utility box of claim 1 and further comprising at least two leg channels disposed on adjacent ones of said vertically disposed corners and on opposite sides of one of said front and rear walls, each of said leg channels having leg channel walls surrounding and defining vertically oriented leg channel interiors;

a telescopically adjustable leveling leg journaled within each of said leg channel interiors; and a plurality of pairs of pin ports disposed in said leg channel walls, said pairs of pin ports adapted to receive pins extending through said leg channel walls and said leveling legs to hold said leveling legs at a selected vertical displacement relative to said leg channels.

4. The roof worker's utility box of claim 3 wherein said at least two leg channels comprises four leg channels, one on each one of said vertically disposed corners of said utility box, said telescopically adjustable leveling legs being independently adjustable one from another.

5. The roof worker's utility box of claim 1 and further comprising anchoring means coupled to said rear wall for anchoring said utility box to said sloped roof.

6. The roof worker's utility box of claim 5 wherein said anchoring means comprises at least one tether means coupled to said rear wall and adapted to extend to an opposite side of said sloped roof for tethering said utility box to said sloped roof.

7. The roof worker's utility box of claim 1 wherein said ladder bracing means comprises a ladder stop coupled to said planar top substantially parallel to said longitudinal axis; and ladder foot braces coupled to said ladder stop and adapted to engage at least two feet of said ladder for securing said ladder to said ladder stop and thereby to said utility box.

8. The roof worker's utility box of claim 1 and further comprising at least one multipurpose tray removably disposed on one of said left and right side walls, said multipurpose tray having a tray top, a tray bottom and at least three tray sides surrounding and defining a tray interior; and a vertically oriented tongue means coupled to one said at least three tray sides and adapted to be received within one of at least one horizontal slot disposed on said one of said let and right side walls, said one of at least one horizontal slot having an upwardly disposed slot mouth adapted to removably receive said tongue means.

9. The roof worker's utility box of claim 1 and further comprising at least one extension platform disposed on said front wall between said front corners of said utility box, said extension platform having a planar work surface having a proximate platform end hingedly coupled to said planar top and an opposite distal platform end, said planar work surface adapted to be disposed coplanar with said planar top; and at least two diagonal braces extending from said distal platform end to couple to said front wall below said proximate platform end.

10. A roof worker's utility box for use on a sloped roof, said utility box comprising substantially planar front and rear and left and right side walls, each of said walls having top, bottom and side edges, said walls coupled together at their adjacent side edges to form vertically disposed corners and to surround and define a utility box interior;

a bottom coupled to said bottom edge of at least one of said planar front and rear and left and right side walls and disposed substantially directly below said utility box interior, said bottom adapted to frictionally engage said sloped roof;

a substantially planar top hingedly coupled to a top edge of one of said front, rear, left and right side walls opposite said bottom and adapted to close said utility box interior, said planar top further having a longitudinal axis; an exterior top surface; and ladder bracing means coupled to said exterior top surface and adapted to brace and support a ladder disposed on top of said utility box;

telescopically adjustable left and right masts extending vertically upward, one each of said left and right masts disposed on one of said two adjacent corners on said front wall, said adjustable masts having X-brace means spanning between said left and right masts for bracing said masts above said planar top;

yard arm means coupled to and spanning substantially horizontally between said left and right masts; and scaffolding means disposed atop and substantially parallel said longitudinal axis for creating a horizontal scaffolding disposed a spaced distance above said planar top;

at least one C-channel collar having a plurality of C-channel vertical walls surrounding a C-channel interior adapted to receive a portion of one of said adjustable masts;

a peg adapted to penetrate transversely through said plurality of C-channel walls and said one of said adjustable masts to secure said C-channel collar in a fixed position relative to said one of said adjustable masts; and a vertically oriented attachment channel disposed on one of said plurality of C-channel walls, said attachment channel adapted to receive a vertically oriented lug disposed on each of a plurality of accessory means for securing said each of a plurality of accessory means to said adjustable masts.

11. The roof worker's utility box of claim 10 and further comprising anchoring means coupled to said rear wall for anchoring said utility box to said sloped roof.

12. The roof worker's utility box of claim 11 wherein said anchoring means comprises at least one tether means coupled to said rear wall and adapted to extend to an opposite side of said sloped roof for tethering said utility box to said sloped roof.

13. A roof worker's utility box for use on a sloped roof, said utility box comprising substantially planar front and rear and left and right side walls, each of said walls having top, bottom and side edges, said walls coupled together at their adjacent side edges to form vertically disposed corners and to surround and define a utility box interior;

a bottom coupled to said bottom edge of at least one of said planar front and rear and left and right side walls and disposed substantially directly below said utility box interior, said bottom adapted to frictionally engage said sloped roof;

a substantially planar top hingedly coupled to a top edge of one of said front, rear, left and right side walls opposite said bottom and adapted to close said utility box interior, said planar top further having a longitudinal axis; an exterior top surface; and ladder bracing means coupled to said exterior top surface and adapted to brace and support a ladder disposed on top of said utility box;

telescopically adjustable left and right masts extending vertically upward, one each of said left and right masts disposed on one of said two adjacent corners on said front wall, said adjustable masts having X-brace means spanning between said left and right masts for bracing said masts above said planar top;

yard arm means coupled to and spanning substantially horizontally between said left and right masts; and scaffolding means disposed atop and substantially parallel said longitudinal axis for creating a horizontal scaffolding disposed a spaced distance above said planar top;

at least one C-channel collar having a plurality of C-channel vertical walls surrounding a C-channel interior adapted to receive a portion of one of said adjustable masts;

a peg adapted to penetrate transversely through said plurality of C-channel walls and said one of said adjustable masts to secure said C-channel collar in a fixed position relative to said one of said adjustable masts; and a vertically oriented attachment channel disposed on one of said plurality of C-channel walls, said attachment channel adapted to receive a vertically oriented lug disposed on each of a plurality of accessory means for securing said each of a plurality of accessory means to said adjustable masts; and at least one tether means coupled to said rear wall and adapted to extend to an opposite side of said sloped roof for tethering said utility box to said sloped roof.

* * * * *